US009051665B2

(12) United States Patent
Zeichner

(10) Patent No.: US 9,051,665 B2
(45) Date of Patent: Jun. 9, 2015

(54) METHOD FOR SCREENING BIOMOLECULES

(76) Inventor: Steven L. Zeichner, Bethesda, MD (US)

( * ) Notice: Subject to any disclaimer, the term of this patent is extended or adjusted under 35 U.S.C. 154(b) by 723 days.

(21) Appl. No.: 12/591,486

(22) Filed: Nov. 20, 2009

(65) Prior Publication Data

US 2010/0152059 A1 Jun. 17, 2010

Related U.S. Application Data

(60) Provisional application No. 61/193,345, filed on Nov. 20, 2008.

(51) Int. Cl.
*C40B 30/04* (2006.01)
*C40B 30/06* (2006.01)

(52) U.S. Cl.
CPC ..... *C40B 30/06* (2013.01); *C40B 30/04* (2013.01)

(58) Field of Classification Search
None
See application file for complete search history.

(56) References Cited

U.S. PATENT DOCUMENTS 6,984,490 B1 * 1/2006 Holden ..... 435/6.15
2008/0286808 A1 * 11/2008 Schellenberger et al. ..... 435/7.8

OTHER PUBLICATIONS

Czerny et al Virology, 200, 1994, 764-777.*
Jiang et al, 15th Conference fn Retroviruses and opportunistic infections, Boston, Ma. Feb. 2008, 15, abs. No. 119.*
Eoin L. Brodie, et al.; App. of a High-Density Oligonucleotide Microarray Approach to Study Bacterial Population . . . ; Microbiology; Sep. 2006; pp. 6288-6298; vol. 72, No. 9.
Eoin L. Brodie, et al.; Urban aerosols harbor diverse and dynamic bacterial populations; Proc Natl Acad Sci USA; 2007; pp. 299-304; vol. 104, No. 1.
C. Schabereiter-Gurtner, et al.; Evaluation of a protocol for molecular broad-range diagnosis of . . . ; Journal of Applied Microbiology; 2008; pp. 1228-1237; vol. 104.
S J Ott, et al.; Reduction in diversity of the colonic mucosa associated bacterial microflora in patients with active inflammatory bowel disease; Gut; 2004; 53; pp. 685-693.
Anne-Laure Rosey, et al.; Development of broad-range 16S rDNA real-time PCT for the diagnosis of spetic arthritis . . . ; Journal of Microbiological Methods; 2007; pp. 88-93.
Franziska Zucol, et al.; ReaTime Quantitative Broad-Range PCR Assay for Detection of the 16S rRNA Gene Followed by . . . ; Microbiology; Aug. 2006; pp. 2750-2759; vol. 44, No. 8.
Remco P H Peters, et al.; New developments in the diagnosis of bloodstream infections; Lancet Infect Disease; Dec. 2004; pp. 751-760; vol. 4.
Nobushisa Masuda, et al.; *Escherichia coli* Gene Expression Responsive to Levels of the Response Regulator EvgA; Bacteriology; Nov. 2002; pp. 6225-6234; vol. 184, No. 2.
Gjalt W. Welling, et al.; Prediction of sequential antigenic regions in proteins; FEBS 2820; Sep. 1985; pp. 215-218; vol. 188, No. 2.
(Continued)

*Primary Examiner* — Christian Boesen
(74) *Attorney, Agent, or Firm* — Michael X. Ye; Andrews Kurth LLP

(57) ABSTRACT

A method for screening biomolecules molecules is disclosed. One embodiment of the method includes inoculating an expression library or a portion of the expression library into an animal, monitoring the relative abundance of individual members of the expression library; and analyzing molecules expressed by members that show significantly reduced relative abundance after inoculation into the animal. Also disclosed is an expression vector and an expression library employing the vector.

6 Claims, 3 Drawing Sheets

(56) References Cited

OTHER PUBLICATIONS

A.S. Kolaskar, et al.; A semi-empirical method for prediction of antigenic determinants on protein antigens; FEBS 09210; Dec. 1990; pp. 172-174; vol. 276, No. 1,2.

Thomas P. Hopp, et al.; A Computer Program for Predicting Protein Antigenic Determinants; Noolecular Immunology; 1983; pp. 483-489; vol. 20, No. 4.

Michael B. Zwick, et al.; Broadly Neutralizing Antibodies Targeted to the Membrant-Proximal External Region of Human . . . ; Virology, Nov. 2001; pp. 10892-10905; vol. 75, No. 22.

Bruck K. Brown, et al.; Biologic and Genetic Characterization of a Panel of 60 Human Immunodeficiency Virus Type 1 . . . ; Virology; May 2005; pp. 6089-6101, vol. 79, No. 10.

* cited by examiner

100

METHOD FOR SCREENING BIOMOLECULES

RELEVANT APPLICATIONS

This application claims priority of U.S. Provisional Application Ser. No. 61/193,345, filed on Nov. 20, 2008, which is hereby incorporated in its entirety.

TECHNICAL FIELD

The technical field is biotechnology assay systems and, in particular, a method for in vivo screening of biomolecules.

BACKGROUND

There are three major mucosal systems in the vertebrate body, the oral-gastrointestinal, the respiratory and the genitourinary systems. The mucosal systems provide a first line of protection against ingested and inhaled infectious agents. The mucus layer covering the mucosal epithelium acts as a physical and biochemical barrier. A tightly interlaced cell-to-cell network of epithelial cells and intraepithelial lymphocytes provides further non-specific protection against microorganisms. The organism also defends against invading microbes through non-specific (for example phagocytes) and specific (for example humoral and secretory antibodies and cell-mediated immunity) actions of the immune system. Lymphoid tissues such as the Peyer's patches in the digestive tract and nasopharynx-associated lymphoid tissue in the respiratory tract have been shown to be important inductive sites for the initiation of the acquired phase of antigen-specific immune responses that help protect the mucosa. Moreover, mucosal compartments, such as the respiratory, genitourinary and gastrointestinal tracts, contain a rich and complex microbial flora or microbiota, which include pathogens, symbionts, and commensals. Some components of the mucosal microbiota can serve as biological barriers by competing with pathogenic bacteria for food and space and, in some cases, by changing the conditions in their environment, such as pH or available iron. The mucosal microbiota may be affected by a number of factors. Immune responses against components of a mucosal compartment microbial flora may lead to changes in the microbial flora. For example, immunization against respiratory pathogens such as *H influenzae* type B or *S pneumoniae* lead to elimination of those organisms from the upper respiratory flora. Therefore, induction of an immune response against a particular component of a mucosal compartment microbial flora can lead to substantial decreases in the relative abundance of that component.

SUMMARY

A method for screening for biomolecules with a desired function is disclosed. The method comprises inoculating an expression library that expresses a plurality of molecules of interest or a portion of the expression library into an animal; monitoring the relative abundance of individual members of the expression library; and analyzing molecules expressed by the members that show significantly altered relative abundance after inoculation into the animal.

In one embodiment, the method includes inoculating the GI system of an animal with a library of bacterial clones expressing antigens to screen for antigens that induce high affinity or broadly neutralizing antibodies. The bacterial clones expressing such antigens, the expression vectors encoding such antigens, or purified, modified, or optimized versions of the expressed antigens could then be used as a vaccine or other immune modulator.

In one implementation of the method, each member of the expression library is labeled with a unique barcode to facilitate the screening and identification of the clone that expresses the antigens targeted by the mucosal immune system. In one embodiment, the barcode consists of a unique DNA sequence that tags the expression vector (such as a plasmid) hosted by the member of the library.

In one implementation of the method, a library or barcoded library is used as a screening device to identify immunogenic antigens compared to other, less immunogenic or non-immunogenic antigens. In one embodiment, the comparison consists of a scaffolding protein that does not, itself, elicit a selective immune response, which includes, in different members of the library a potential immunogenic antigen at different locations in the scaffolding protein. The potentially immunogenic antigen may be too small or poorly configured, by itself, to assume the desired immunogenic secondary or tertiary structure, but may, at some position in the scaffolding protein, be able to assume such an immunogenic structure. The immunogenic location within the scaffolding protein may then be determined by screening the library.

Also disclosed is an expression vector. The expression vector contains an expression cassette having a promoter and a coding sequence under transcriptional control of the promoter, at least one selectable marker, and a DNA barcode that allows identification of the expression vector.

Also disclosed is a surface expression library comprising a plurality of library members. Each library member contains an expression vector described above.

BRIEF DESCRIPTION OF DRAWINGS

The detailed description will refer to the following drawings, wherein like numerals refer to like elements, and wherein.

DETAILED DESCRIPTION

Figure 1:
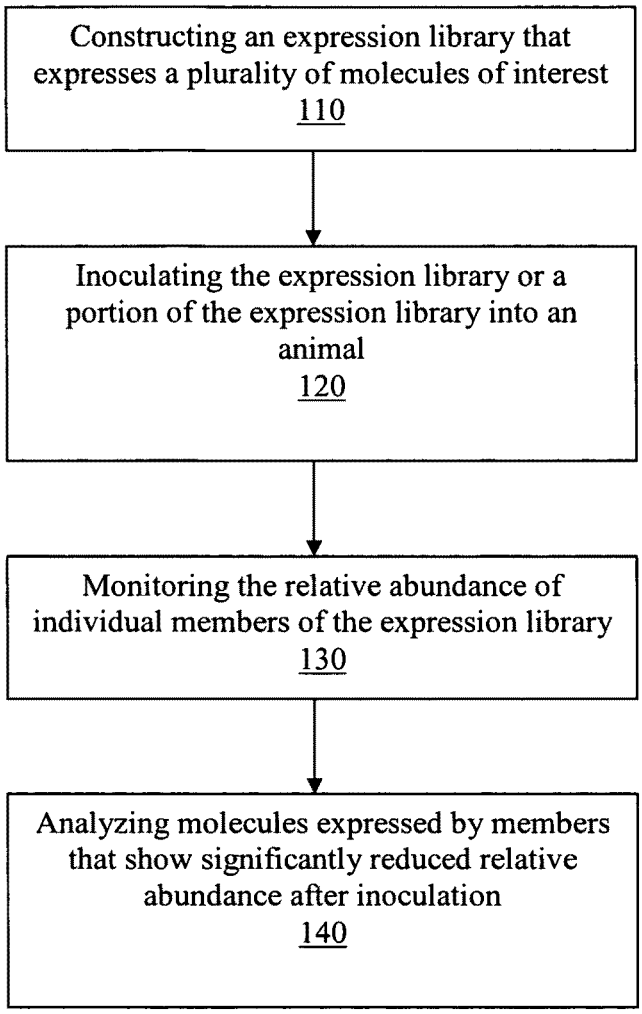
FIG. 1 is a flowchart showing an embodiment of a method for in vivo screening of biomolecules using an expression library.

This description is intended to be read in connection with the accompanying drawings, which are to be considered part of the entire written description of this invention. The drawings are not necessarily to scale and certain features of the invention may be shown exaggerated in scale or in somewhat schematic form in the interest of clarity and conciseness.

As used herein the specification, "a" or "an" may mean one or more. As used herein in the claim(s), when used in conjunction with the word "comprising", the words "a" or "an" may mean one or more than one.

The term "biomolecule," as used herein, refers to a molecule that can be present in a biological sample. Examples of biomolecules comprise amino acids, peptides, proteins, nucleic acids, oligonucleotides, polynucleotides, and the like.

The term "antibody", as used herein, is defined as an immunoglobulin that has specific binding sites to combine with an antigen. The term "antibody" is used in the broadest possible sense and may include but is not limited to an antibody, a recombinant antibody, a genetically engineered antibody, a chimeric antibody, a mono-specific antibody, a bi-specific antibody, a multi-specific antibody, a chimeric antibody, a hetero-antibody, a monoclonal antibody, a polyclonal antibody, a camelized antibody, a de-immunized antibody, and an anti-idiotypic antibody. The term "antibody" may also include but is not limited to an antibody fragment such as at least a portion of an intact antibody, for instance, the antigen binding variable region. Examples of antibody fragments include Fv, Fab, Fab', F(ab'), $F(ab')_2$, Fv fragment, diabody, linear antibody, single-chain antibody molecule, multi-specific antibody, and/or other antigen binding sequences of an antibody.

The term "antigen" as used herein is defined as a molecule that provokes an immune response. This immune response may involve either antibody production, the activation of specific immunologically-competent cells, or both. A skilled artisan realizes that any macromolecule, including proteins, glycoproteins, polynucleotides, carbohydrates, lipids and glycolipids can serve as antigens.

The term "expression vector" as used herein refers to a vector containing a polynucleotide sequence coding for at least part of a gene product capable of being transcribed. Expression vectors can contain a variety of control sequences, which refer to polynucleotide sequences necessary for the transcription and possibly translation of an operatively linked coding sequence in a particular host organism. In addition to control sequences that govern transcription and translation, vectors and expression vectors may contain polynucleotide sequences that encode a fusion partner, a tag, or a selectable marker. One skilled in the art realizes that an "expression vector" and a "plasmid" are interchangeable. Many expression vectors are commercially available for expression in a variety of cells. Selection of appropriate vectors is within the knowledge of those having skill in the art.

The term "expression library," as used herein, refers to a plurality of host organism clones, such as bacteria, yeast, fungi, protozoa clones. Each clone (i.e., member of the library) hosts at least one expression vector and expresses at least one target molecule. The target molecule may be a molecule transcribed or translated directly from an expression vector harbored in the library, such as a polynucleotide or a polypeptide. The target molecule may also be a molecule that is not directly encoded by an expression vector harbored in the library. For example, the target molecule may be a polysaccharide that is modified by an enzyme expressed from an expression vector harbored in the library.

The term "promoter" as used herein is defined as the region of polynucleotide sequence, which regulates transcription of a specific polynucleotide sequence. The term promoter includes enhancers, silencers and other cis-acting regulatory elements. One of skill in the art is cognizant that the "promoter" refers to the nucleotide sequence recognized by the synthetic machinery of the cell, or introduced synthetic machinery, required to initiate the specific transcription of a gene.

The phrase "under transcriptional control" or "operatively linked" as used herein means that the promoter is in the correct location and orientation in relation to the polynucleotide sequence to control RNA polymerase initiation and expression of the gene.

Referring now to FIG. 1, a method for screening biomolecules is disclosed. In the embodiment shown in FIG. 1, the method 100 includes: constructing (110) an expression library that expresses a plurality of molecules of interest; inoculating (120) the expression library or a portion of the expression library into an animal, monitoring (130) the relative abundance of individual members of the expression library, and analyzing (140) molecules expressed by the members that show significantly altered relative abundance after inoculation into the animal.

Construction of an Expression Library

The expression library is composed of a collection of host organism clones that express a plurality of molecules of interest. Methods for constructing (110) an expression library is well known in the art.

Expression Vector

In one embodiment, the expression library is constructed by cloning overlapping fragments of a particular gene or a genome into an expression vector, which typically contains a multiple cloning site (MCS) flanked by a promoter region. The genes or genomes of interest include but are not limited to, genes or genomes of bacteria such as *Helicobacter, Campylobacter, Clostridia, Corynebacterium diphtheriae, Bordetella pertussis, Listeria, Legionella, Staphylococcus, Streptococcus, Salmonella, Bordetella, Pneumococcus, Rhizobium, Chlamydia, Rickettsia, Streptomyces, Mycoplasma, Chlamydia pneumoniae, Coxiella burnetii, Borrelia burgdorfei, Vibrio cholera, Escherichia coli Salmonella typhi, Neisseria gonorrhea, Haemophilus*, and *Shigella*, viruses such as influenza virus, parainfluenza viruses, respiratory syncytial virus, hepatitis viruses, herpes simplex viruses, human immunodeficiency virus, papilloma virus, measles virus, rotavirus, and other enteroviruses, and *Plasmodium*. In one embodiment, the gene or genome of interest is from the human immunodeficiency virus.

In another embodiment, the genes of the expression library are chemically synthesized, incorporating the desired immunogenic or other characteristics.

In another embodiment, the expression library is constructed by cloning cDNAs prepared from cells, tissues, or organisms of interest into the expression vector. Those skilled in the art will be aware that cDNA is generated by reverse transcription of RNA using, for example, avian reverse transcriptase (AMV) reverse transcriptase or Moloney Murine Leukemia Virus (MMLV) reverse transcriptase. Such reverse transcriptase enzymes and the methods for their use are known in the art, and are obtainable in commercially available kits, such as, for example, the Powerscript® kit (Clontech), the Superscript II® kit (Invitrogen), the Thermoscript® kit (Invitrogen), the Titanium® kit (Clontech), or Omniscript® (Qiagen).

In another embodiment, the expression library is constructed by introducing a gene fragment into a chimeric protein expression vector carrying a scaffolding protein gene. In certain embodiments, the scaffolding protein is a non-immunogenic protein. Examples of scaffolding proteins include, but are not limited to, albumin, growth hormone, erythropoietin, thrombopoietin, β2-microglobulin, secreted alkaline phosphatase (SEAP), interferon γ receptor (IFNγR). The gene fragment encodes a target peptide and is cloned into different regions of the scaffolding protein gene. The resulting expression vectors express chimeric scaffolding proteins having the target peptide fused at various positions of the scaffolding protein. The scaffolding protein, in this embodiment, may help direct the peptide to fold into the required functional or immunogenic secondary and tertiary structure.

In another embodiment, the target peptide or antigen does not by itself elicit an effective or high affinity or highly effect immune response when used to immunize an animal. However, this antigen does elicit such desired immune response when expressed at some location within a scaffolding protein. However, in this embodiment it is not known where within the scaffolding protein to place the target peptide or antigen to elicit the desired immune response. Screening a large library of scaffolding proteins with the target peptide or antigen inserted at different locations within the scaffolding protein will identify the location within the scaffolding protein that will elicit the desired immune response, which could be a broadly neutralizing immune response directed against a pathogen, or a high affinity immune response, or other immune response.

In another embodiment, multiple gene fragments are introduced into the chimeric protein expression vector and chimeric proteins having different peptides fused at the same position or different peptides fused at different positions are expressed. The gene fragment or fragments may, in one embodiment, come from the genome of a human pathogen.

In one non-limiting example, the gene fragments encodes peptide 20 mers, which are fragments of one or more genome-encoded proteins. In this embodiment, the peptides are contiguous or nested, with a degree of overlap typically ranging from 0 to about 10. Preferably, the sequences are nested with a constant degree of overlap. For a genome-encoded protein comprising a single chain of 100 amino acid residues, one set of contiguous 20 mers will have the following sequences: 1-20; 21-40; 41-60; 61-80; and 81-100, for a total of 5 distinct sequences. If the degree of overlap is 2, one set of sequences beginning at the N-terminus would be 1-20; 18-37; 35-54; 52-71; 69-88; and 81-100. Beginning at the C-terminus, the sequences would be 81-100; 63-82; 45-64; 27-46; 9-28 and 1-20. Thus a total of 10 distinct sequences result from nesting with a degree of overlap of 2. If the degree of overlap is 5, the sequences beginning at the N-terminus would be 1-20; 16-35; 31-50; 46-65; 61-80; 76-95 and 80-100. Beginning at the C-terminus, the sequences would be 80-100; 65-84; 50-69; 35-54; 20-39; 5-24 and 1-20. Thus, a total of 12 distinct sequences result from a degree of overlap of 5. If the degree of overlap is 10, beginning at the N-terminus, the fragments produced are 1-20; 11-30; 21-40; 31-50; 41-60; 51-70; 61-80; 71-90; and 81-100, a total of 9 distinct sequences. If the degree of overlap is 19 (n−1), the possible peptides, starting from the N-terminus, include 1-20; 2-21; 3-22, 4-23; 5-24, and so forth, up to 81-100, for a total of 81 peptides. In other non-limiting examples, the gene fragments encodes 8-50 mers which are fragments of one or more genome-encoded proteins.

Gene fragments encodes such a collection of peptides can be prepared using, for example, fragmented genomic or enzymatically digested DNA or synthetic nucleic acid sequences, for example, sequences derived from the genome of the organism and designed to provide peptides having the desired nesting and representing the entire genome or a desired portion of the genome or a particular gene. Gene fragments encoding such a collection of peptides can also be prepared using fragmented or enzymatically digested cDNA. After cloning the gene fragments into a chimeric protein expression vector, the expression vectors are transformed into host cells to form a library of clones that express a collection of chimeric proteins on the cell surface.

In one embodiment, the expressed chimeric proteins consist of (1) a relatively inert or non-immunogenic scaffolding protein or a scaffolding protein with some desired function and (2) a peptide of interest replacing or inserted into the native sequence of the scaffolding protein. The peptide of interest may not be able to induce an immune response in isolation, but may induce an immune response when expressed in the context of a scaffolding protein. The fusion protein may also enable the potentially bioactive parts of the peptide of interest to associate in a function configuration, for example as multimers. This may be done by, as non-limiting examples, expressing the proteins at very high levels on the surface of bacterial cells so that the molecules associate into multimers or aggregates due to the affinity the molecules have for each other. In another non-limiting example the molecules may be expressed via surface transporters that naturally transport and express proteins on the surfaces of cells as multimers, for example the Gram-negative trimeric autotransporters such as the Hia protein of *Haemophilus influenzae*. When expressed on the surface of a cell, the fusion protein may also tether parts of the peptide of interest in close proximity to the cell's membrane, which may be needed for the peptide of interest to assume an optimal or immunogenic configuration. In certain embodiments, the fusion protein contains a backbone peptide that is capable of forming homopolymers, a scaffold peptide and a target peptide. The target peptide may be fused with the scaffold peptide at various locations. The scaffold peptide, in turn, may be fused to the backbone peptide at various locations.

The expression vector may be constructed to express molecules other than peptides and proteins. In one embodiment, the expression vectors are constructed to express RNA molecules such as antisense RNA or siRNA. In another embodiment, the expression vectors are constructed to express DNA molecules.

It should be noted that the molecules of interest expressed by the expression library is not limited to the molecules expressed from the expression vectors. The molecules of interest can be molecules whose production or characteristics are affected by the molecules expressed from the expression vector. For example, the expression vectors may be constructed to carry a collection of enzymes that modify the glycosylation pattern of a bacterial surface glycoprotein. The expression library carrying such vectors is then screened for the immunogenicity of the modified surface glycoprotein.

In another embodiment, the expression vectors are constructed to express different variants of enzymes or other functional proteins that are subject to selection based on function instead of immunogenicity.

Host Cells

The expression vectors, once constructed, are introduced into host cells to form the expression library. The host cells can be any cells that are capable of harboring the expression vector and express the molecules of interest encoded by the expression vector. In one embodiment, the host cells are microbes that are capable of inhabiting in a mucosal compartment of an animal. Examples of such microbes include, but are not limited to, bacteria, yeast, fungi and protozoa. In another embodiment, the host cells are bacteria capable of inhabiting in the gastrointestinal (GI) tract of an animal. Examples of such bacteria include, but are not limited to *Escherichia coli*, including strains isolated base on their ability to become resident in the GI tract of an animal, *Salmonella* species (especially vaccine strains of *Salmonella*), *Listeria* (including vaccine strains of *Listeria*), and other GI resident species. Other microbes that inhabit other mucosal compartments, such as the oro-pharyngeal mucosa or genital tract mucosa may also be used.

Methods for introducing an expression vector into a host cell are well known in the art. For example, vector DNA can be introduced into a host cell via conventional transformation or transfection techniques, such as calcium phosphate or calcium chloride co-precipitation, DEAE-dextran-mediated transfection, lipofection, or electroporation. Suitable methods for transforming or transfecting host cells can be found in Sambrook, et al. (Molecular Cloning: A Laboratory Manual. 3rd, ed., Cold Spring Harbor Laboratory, Cold Spring Harbor Laboratory Press, Cold Spring Harbor, N.Y., 2001).

DNA Barcode

The individual clones in the expression library may be marked with "DNA barcodes." A DNA barcode is a DNA sequence of base pairs that is inserted into the expression vector during the cloning process. Each individual clone of the expression library is marked with a unique DNA barcode that would facilitate identification of the clone. For example, incorporation of DNA barcodes into the expression vectors allows the identification of individual expression vector clones using microarray systems, PCR, nucleic acid hybridization (including "blotting") or high throughput sequencing. In one embodiment, the DNA barcodes are derived from the 16S rRNA genes of non-GI microbes and are used together with the Affymetrix microbial 16S rRNA gene PhyloChip microarray platform or high throughput DNA sequencing. Many other barcodes may also be used, including barcodes that are recognized by other nucleic acid detection systems, such as nucleic acid hybridization techniques or PCR. DNA barcodes may be prepared by carefully considering the performance characteristics of the assays that will be used to detect the barcodes. The barcodes may then be synthesized using any of the many readily available DNA synthesis techniques. The DNA barcode is designed to have a sufficient length to provide a unique identifier to each member of the expression library. In certain embodiments, the DNA barcodes may contain 6-100 nucleotides, 10-80 nucleotides or 20-60 nucleotides. Each unique barcode may be cloned into the appropriate location of the expression vector, producing a large library of barcoded plasmids where each component of the library consists of a plasmid labeled with a unique barcode. DNA encoding each different candidate for the screening procedure may then be cloned into a different unique barcoded plasmid such that each plasmid contains both a unique gene or gene fragment for screening and a corresponding unique barcode to label the plasmid expressing the gene fragment.

rRNA genes not present in the microbial flora of the GI tract can be used as barcodes together with high throughput techniques to identify rRNA genes in general to identify and quantitate the barcodes, for example using the PhyloChip or high-throughput sequencing. Other DNA sequences not normally found in GI flora may also be used.

Inoculation of the Expression Library

In one embodiment, the expression library or a portion of the expression library is inoculated into the microbial flora of a mucosal compartment in an animal having a functional mucosal immune system. The mucosal compartment can be any mucosal surface such as the oropharynx, the skin, the respiratory tract, the reproductive tract, and the gastrointestinal (GI) tract.

The expression library or a portion of the expression library may be inoculated into the GI tract of an animal by instillation or conventional feeding technology. In one embodiment, the microbial members of the expression library are inoculated into a growth medium, cultured for a desired period of time, harvested by centrifugation or filtration, titered, resuspended at a desired concentration in a liquid medium, and the microbial members of the library combined together at a desired concentration and relative abundance (for example, with equal representation of all microbial members of the library).

A desired amount of the resuspended, live pooled microbes (hereinafter "pre-inoculation library") is introduced into the GI tract of an animal using devices well known in the art, such as pipets, feeding tubes, gavage syringes, balling guns, direct instillation etc. Alternatively, the resuspended microbes may be mixed with solid food and fed to the animal. Aliquots of the resuspended microbes are also saved and analyzed for the relative abundance of each microbial member in the pre-GI library. The resuspended microbes may be given in a single dose or in multiple doses over a period of time.

The animal can be any animal that has a functional mucosal immune system. Examples of such animals include, but are not limited to, laboratory animals such as mice, rats, guinea pigs, and rabbits; pets such as cats and dogs; and farm animals such as pigs, sheep, goat, cow, chicken, ducks and geese. The animals may also be animals that would be particularly useful in the production of large amounts of polyclonal antibodies.

Other embodiments may include inoculation of the library into other mucosal compartments, with non-exclusive examples being the nasal, oral, oro-pharyngeal, respiratory, and genito-urinary tracts.

Additional non-exclusive embodiments may include non-mucosal inoculation of the libraries into other non-mucosal compartments of an organism, including, as non-exclusive examples, individual organs, the circulation system, peritoneal cavity, lymphoid tissues, or lymphatic system.

Monitoring the Relative Abundance of Library Members

The relative abundance of individual clones of the expression library is monitored after inoculation to identify clones that show significantly altered relative abundance after inoculation into the animal.

In the case of inoculation into the GI tract, the relative abundance of individual clones of the expression library after inoculation can be monitored from feces collected at various time points after inoculation. The time of collection may be determined experimentally depending on the species and age of the experimental animal, the vector used and its ability to persist in the GI tract, and the immunogenicity of the construct.

The relative abundance of individual clones in the pre-inoculation library and post-inoculation library can be determined by detecting markers on individual members of the expression library. In certain embodiments, each individual member of the expression library has a unique marker.

In one non-exclusive embodiment, the pre-inoculation library and post-inoculation library is assayed with high throughput microbial genomics technologies described by Brodie et al. (Brodie E L et al, Appl Environ Microbiol 2006; 72(9):6288-98) which is incorporated herein by reference. In this embodiment, the expression vectors are each labeled with a DNA barcode. The plasmid DNA is extracted from the pre-inoculation library and from samples collected after the organism is exposed to the library, and hybridized to microarrays that recognize the DNA barcodes on each individual expression vector. The relative abundance of each expression vector (and hence the bacterial clone that hosts the vector) is determined based on the density of corresponding hybridization signal on the microarray. As an example of this embodiment, if the input library contains equimolar quantities of the clones expressing different immunogens, the output population of plasmid-bearing bacteria will be depleted in members of the initial inoculum against which the immune of the organism mounts an immune response.

Other methods of determining the relative abundance of the different clones may also be used. Some non-exclusive examples of these other methods of comparing the relative abundance of clones in the input inoculum and the output of the microbial population following exposure of the animal to the library include: high-throughput sequencing and assessment of the relative abundance of the sequences obtained from the clones, direct hybridization to probes for the individual clones, PCR using specific primers or gene-specific detector probes. For the high throughput sequencing example, the relative abundance of each clone may be estimated by comparing the number of times a particular sequence is obtained with the total number of sequences determined or by comparing the number of times one sequence is obtained with the number of times other sequences are obtained or with one or more control sequences. High throughput sequencing, direct hybridization, or PCR using specific primers or gene-specific detector probes may be applied to the library, input inocula, or output samples as a whole, or to subsamples, isolated bacteria, isolated plasmids, isolated nucleic acids, including specifically or non-specifically amplified nucleic acids. The microarray detection, high throughput sequencing, direct hybridization, or PCR using primers or gene-specific detector probes may be used to detect the DNA barcodes, or may be used to detect any other distinguishing feature of the plasmids or clones. In one non-exclusive example, this distinguishing feature would include the sequence of the expressed gene.

The relative abundance of specific clones, bacteria, or plasmids may also be accomplished using methods other than those based on the detection of specific nucleic acid sequences. In one non-exclusive embodiment, these other detection methods include antibodies that recognize specific antigens, or other reagents having differential affinity for certain members of the library, such as large or small molecule ligands or substrates.

The relative abundance of certain microbial members (i.e., microbial clones) may be altered because the mucosal immune system will mount an immune response against the molecules present within or on the surface of these microbial clones. The immune response can be a humeral immune response, a cellular immune response or both. For example, a bacterial clone that expresses an antigen capable of triggering a GI immune response will be at a disadvantage in inhabiting in the GI tract and therefore shows a reduced relative abundance in the post-inoculation library. In one embodiment, a significant reduction is defined as a reduction that is twice of the standard deviation of the relative abundance in the post-inoculation library. The clone that shows a significantly altered relative abundance after inoculation is deemed an inoculation-sensitive clone. In certain embodiments, "a clone that shows significantly altered relative abundance" refers to a clone that has a post-inoculation relative abundance, measured within 8 weeks of inoculation, that is reduced or increased by at least 10%, 20%, 30%, 40%, 50%, 75% , 100%, 150% or 200% compared to the pre-inoculation relative abundance of the same clone. In other embodiments, "a clone that shows significantly altered relative abundance" refers to a clone that has a post-inoculation relative abundance, measured within 8 weeks of inoculation, that is reduced or increased by at least 10%, 20%, 30%, 40%, 50%, 75%, 100%, 150% or 200% compared to the post-inoculation relative abundance of a control clone.

Analysis of Inoculation-Sensitive Clones

Clones exhibiting a significant alteration in relative abundance in the post-inoculation library are then examined to determine whether the gene or gene fragment encoded by the expression vectors hosted in these clones are responsible for the reduction in relative abundance.

If a reduction in relative abundance is due to mucosal immune responses to the molecules expressed from the expression vectors harbored in these inoculation sensitive clones, these immunogenic molecules will be isolated for further investigation. For example, an immunogenic molecule may be tested for its ability to induce broadly neutralizing antibodies against the source organism from which the immunogenic molecule derives. In one embodiment, serum and mucosal washes from the animal inoculated with an expression library are analyzed for their ability to bind to the inoculation-sensitive clones, the molecules expressed by the inoculation-sensitive clones, and/or the source organism of the expression molecules, and/or demonstrate the ability to inhibit or neutralize the growth of the source organism.

Other Applications

The mucosal system may be used for screening an expression library based on features other than immunogenicity. For example, a gain of function that would enable a bacterial clone possessing that gain of function to survive better within an environment. One embodiment of this method would be to confer a nutritional advantage on the clone or a survival advantage through adhesiveness to the GI tract. Another embodiment of the method would be a gain of function, for example by optimizing or enhancing enzyme active sites or altering enzyme kinetic properties that would enhance or restrict survival within the host environment such as the GI tract.

At its most general application, the present invention describes a functional screen based on evolutionary Darwinian principles such that a selective advantage or disadvantage is engineered into a small number of the members of a large library and then the evolutionary system is presented with the library and selection allowed to act to identify the antigen of interest or other function of interest, with Darwinian selection operating upon the library within or on a human or animal body, using properties (native or engineered) of the human or animal body as the selective agent.

EXAMPLES

Example 1

Figure 2:
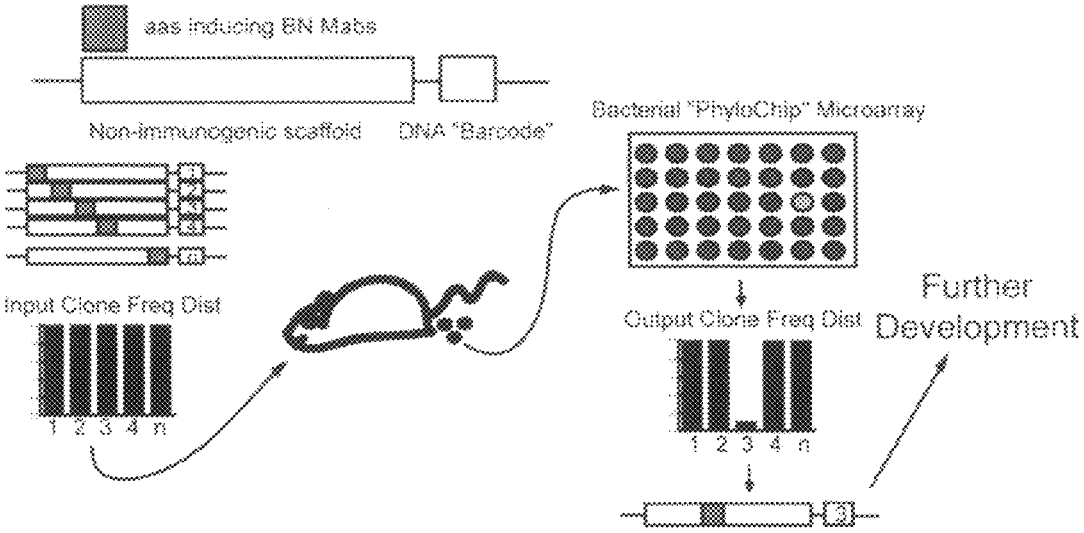
FIG. 2 is a schematic diagram showing the GI selection of immunogenic peptides.

Identification of HIV Immunogen Capable of Inducing Effective, Broadly Neutralizing Antibodies (BN-Ab) to HIV (1) Experimental Design As shown in FIG. 2, DNAs encoding an antigen known to be the binding site for BN anti-HIV Abs will be cloned into an expression vector at serial locations within a relatively non-immunogenic scaffolding protein. Here the expectation is that, while a small peptide containing the binding site for the BN Abs is not, by itself, capable of eliciting the production of the BN Abs, probably because the small peptide cannot fold into the correct shape recognized by the BN Abs, if the peptide is expressed at some location within the scaffolding protein it can assume the correct shape to elicit the production of BN Abs. Each clone containing the sequence encoding the HIV peptide that binds the BN Abs will have that sequence placed in a different location within the scaffolding protein. Each clone will also be uniquely identified with a DNA barcode for each clone. The DNAs expressing the chimeric scaffolding protein-HIV peptide protein will be expressed in bacteria. The bacterial hosts will be introduced into the GI tract of an animal. The GI sensitive clones will be identified and subjected to further analysis. A similar experimental design may be applied to other potential pathogens that contain epitopes, including normal hidden, or cryptic epitopes, that can induce a broadly neutralizing immune response. One non-limiting example of another pathogen with such an epitope is Influenza A.

(2) Construction of Test Expression Vectors

Figure 3:
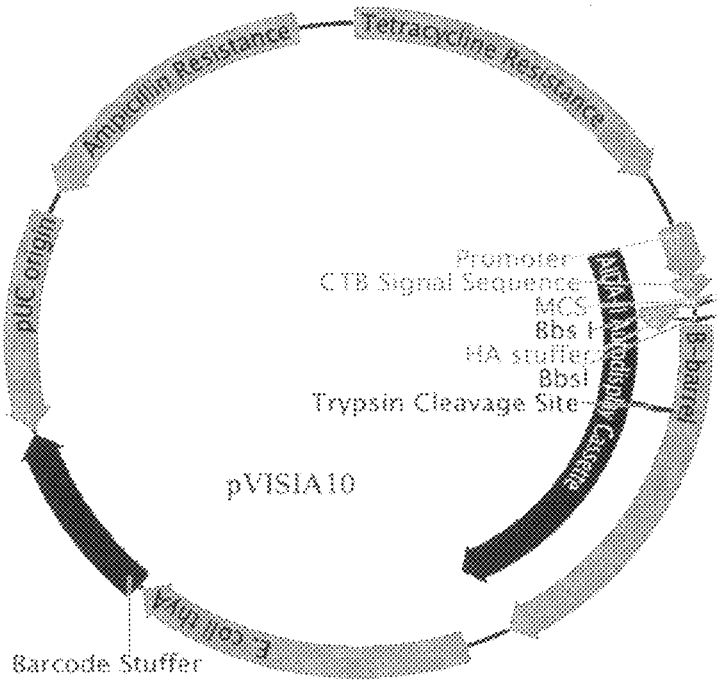
FIG. 3 is a map of the pVISIA10 expression vector.

An example of an expression vector is shown in FIG. 3. The expression vector, designated pVISIA10 (SEQ ID NO:1), has several key design features: 1) Two antibiotic resistance genes, for in vitro manipulations and for potential selection in vivo with depletion of the endogenous GI microbiota, if required, 2) An *E coli* thyA gene (SEQ ID NO:2) for in vivo stabilization in a thyA-bacterial vaccine host in case immune responses/selection were better without antibiotic conditioning/depletion of the GI microbiota and for potential eventual use without antibiotic conditioning in future potential non-human primate and clinical trials, 3) An AIDA-I autotransporter expression cassette (SEQ ID NO:3) to direct expression of a membrane proximal ectodomain region amino acid sequence (MPER aas)-scaffolding protein chimera to the surface of the outer membrane of Gram-negative bacteria (the expression cassette has a stuffer with Type IIS restriction sites; cleavage with the restriction enzyme followed by ligation of the synthgene insert made with appropriate sticky overhangs results in a "scarless" insert cloning event that does not carry many of the problems associated with cloning into a traditional multiple cloning site), 4) A stuffer with different Type IIS restriction sites for insertion of the DNA barcodes (see below), 5) An origin of replication. A trypsin cleavage recognition site is included within the surface expression cassette to enable examination of surface expression characteristics of the chimeric proteins and to facilitate future studies involving preparation of larger quantities of isolated chimeric protein to enable, for example, studies of BN Mab antibody interactions with the chimeric proteins BN Mab neutralization inhibition studies.

Figure 4:
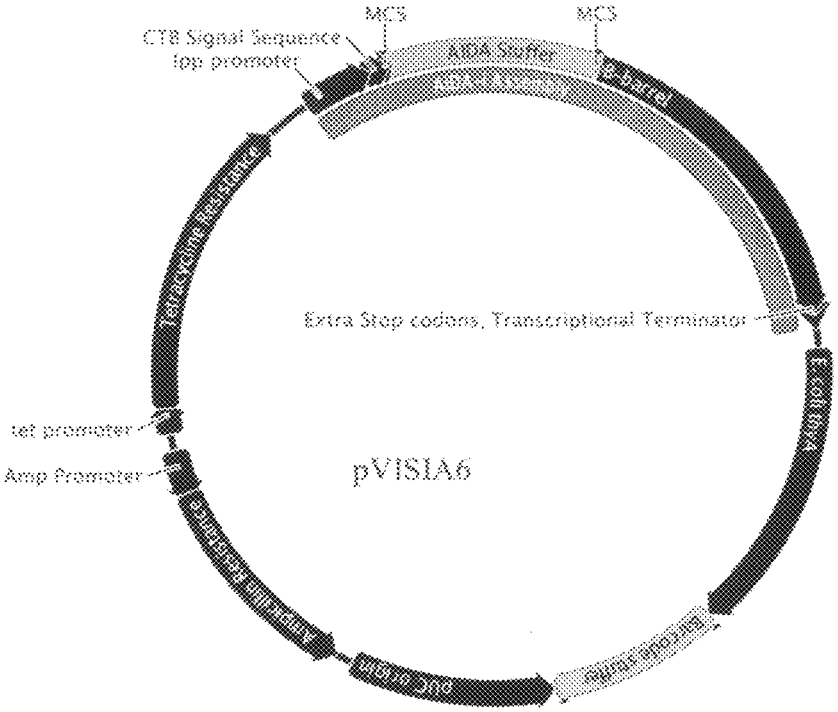
FIG. 4 is a map of the pVISIA6 expression vector.

Another example of an expression vector is shown in FIG. 4. The expression vector, designated pVISIA6 (SEQ ID NO:4), is similar to pVISIA10 but contains an AIDA-I autotransporter expression cassette (SEQ ID NO:5) with extra stop codons and a transcriptional terminator sequence (SEQ ID NO:6) at the 3'-end.

Figure 5:
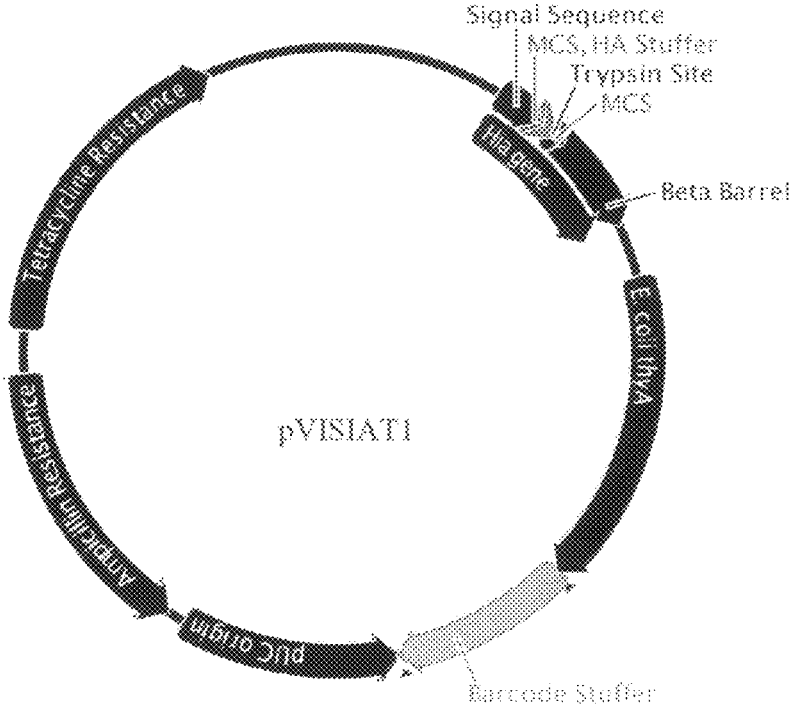
FIG. 5 is a map of the pVISIAT1 expression vector.

Yet another example of an expression vector is shown in FIG. 5. The expression vector, designated pVISIAT1 (SEQ ID NO:7), is a modified version of the pVISIA series of plasmids in which the surface expression cassette employs the *Haemophilus influenzae* Hia trimeric autotransporter (SEQ ID NO:8) in place of the AIDA-I monomeric autotransporter employed in pVISIA6 and pVISIA10. With pVISIAT1, the passenger proteins are expressed on the surface of the bacteria as trimers, which may enhance their ability to fold into a structure better resembling their native, particularly for proteins that exist as trimers in their native conformation. Various versions of the pVISIAT series of plasmids have been created with different numbers of amino acids.

(3) Initial Definition of the Screening System and Selection of Scaffolding Proteins Before the construction of large libraries of iterative scaffolding protein-MPER chimeras the screening system will be defined and optimized. A collection of 10 potential scaffolding proteins will be studied. These potential scaffolding proteins were chosen because: 1) They are known to be relatively non-immunogenic (versions of the proteins have been administered to patients as drugs over relatively long periods with little evidence of immunogenicity), 2) They have a variety of structural features to provide different secondary and tertiary structure environments to maximize the opportunities of driving the MPER sequence into a conformation close to the conformation that elicits a BN immune response, 3) Relatively few or no disulfide bonds, which can trap proteins expressed via autodisplay systems in the periplasmic space. For example, the first group of relatively non-immunogenic proteins will include, e.g., the murine versions of growth hormone, erythropoietin, thrombopoietin, β2-microglobulin, SEAP, IFNγR. Plasmids encoding proteins known to elicit a strong immune response such as *P. falciparum* circumsporozoite protein, *Y. enterocolitica* Hsp60, and *H. pylori* urease will also be created as positive controls using an AIDA-I surface expression system. Surface expression will be verified by trypsin treatment and gel electrophoresis of the bacteria containing the recombinant plasmids. Pools containing equal amounts of bacteria (CFUs) expressing the test synthgene scaffolding proteins (and containing barcoded empty vector controls) will be prepared and inoculated into CB6F1 mice. Feces will be collected after 24 h, 48 h and every 3 days for 2 weeks, then weekly for 6 more weeks. Every other specimen will be initially analyzed to determine whether there is any evidence of selection. If it appears that one or more of the saved, but not assayed time points would more effectively demonstrate selection, the unassayed fecal samples will be examined. Fecal microbial DNA will be isolated and relative abundances of bacterial clones will be determined using PhyloChips (see below).

To define and optimize the ISIA approach, small groups of 3 animals each will be inoculated with $10^6$, $10^8$, and $10^{10}$ total organisms. Plasmid-containing bacterial stocks will be grown in LB with selection, washed in LB, concentrated and titered. Oral inoculation will be done in 50 μl volume in 0.4% lactose and 0.9% NaCl. Input inocula will be saved for microarray input determination and confirmation of input clone abundance. Both *E coli* and *Salmonella* strains will be used. Choice of bacterial strains will determined in the optimization experiments, but certain strains, such as the ATP-dependent protease Lon-deficient *Salmonella* serovar *Typhimurium* (strain CS2022), which can establish a persistent, but not life-threatening infection in mice will be the first choice in the initial optimization experiments. The thyA-*Salmonella* strains, which are suitable for metabolic stabilization alone, without antibiotics will also be evaluated. The initial experiments will include groups of mice that are both pre-conditioned and stabilized in vivo with antibiotics (tetracycline and ampicillin) and with metabolic stabilization alone. Mice will be maintained in metabolic cages, which allows for the easy collection of fecal samples and the pellets produced in the 24 h before the collection time will be used in the subsequent experiments. Other candidate *E coli* strains include strains known to grow in and colonize the mouse GI tract, such as BJ4 or MG1655 (available from ATCC). The bacteria will then be transformed with the pVISIA-derived plasmids to create bacterial pools expressing the chimeric proteins that are then subject to selection by the GI tract mucosal immune system.

DNA Extraction from Stool Samples

Approximately 1 g (~25 mouse fecal pellets) will be used for DNA isolation using one of the well-developed kit methods for the isolation of bacterial and plasmid DNA from mouse feces (Mo Bio UltraClean™ Fecal DNA Kit; Qiagen QIAamp DNA Stool Mini Kit). DNA will be assayed for total microbial DNA by realtime PCR assay for conserved 16S rRNA sequence to confirm that the isolation yielded microbial DNA sufficient to enable the PhyloChip studies prior to attempting to using the PhyloChips.

Quantitation of Total Microbial DNA.

Total microbial DNA will be quantitated and assayed via a modification of a described method (Jiang W et al. 15th Conference on Retroviruses and Opportunistic Infections; 2008; Boston; 2008. p. 118) using Taqman realtime PCR for conserved 16S rRNA gene sequences. DNA will be isolated and quantitated spectrophotometrically as described above. Realtime PCR (Taqman) will be run as described (Schabereiter-Gurtner C et al., J Appl Microbiol 2008; 104(4):1228-37). Several alternative realtime PCR assays for microbial DNA quantitation in plasma may also be used (See e.g., Ott S J et al., Gut 2004; 53(5):685-93; Rosey A L et al., J Microbiol Methods 2007; 68(1):88-93; Zucol F et al., J Clin Microbiol 2006; 44(8):2750-9; and Peters R P et al., Lancet Infect Dis 2004; 4(12):751-60).

Analysis of GI Community Composition Using the Affymetrix PhyloChip Platform.

16S rRNA Gene Amplification.

The same PHYLOCHIP will be used to assay overall composition of the GI microbiota and assay for different individual plasmids expressing the scaffolding proteins and scaffolding protein-MPER chimeras. For the overall quantitation of the microbiota, 16S rRNA gene amplification from 100 ng of DNA extracted from mouse feces will be performed by using universal primers 27F.1 (5'-AGRGTTTGATCMTGGCTCAG-3', SEQ ID NO:9) and 1492R (5'-GGTTACCTTGTTACGACTT-3', SEQ ID NO:10). Each PCR reaction mix will contain 1× ExTaq buffer (Takara), 0.8 mM dNTP mixture, 0.02 units/ml ExTaq polymerase, 0.4 mg/ml BSA, and 1.0 mM each primer. PCR conditions will be 95° C. (3 min), followed by 35 cycles 95° C. (30 s), 53° C. (30 s), 72° C. (60 s), and a final extension 72° C. (7 min). A total mass of 2 μg in<40 μl of PCR product (~1,500 bp) per sample is required, which according to our experience is readily attainable. However, if a sample is recalcitrant to amplification, several individual PCRs will be combined. For archaeal 16S rRNA gene amplification, primer 27F is substituted by the archaeal specific primer 4Fa (5'-TCCGGTTGATCCTGCCRG-3', SEQ ID NO:11). Bacterial and archeal PCR products are pooled prior to processing. For the detection of the barcoded plasmids, the barcode region will be PCR amplified using PCR primers for the pVISIA regions flanking the barcodes. Amplification will be performed as described above, and the barcode amplimers and genomic 16S rRNA gene amplimers combined (1:100 ratio) prior to preparation, labeling and hybridization for PHYLOCHIP.

16S rDNA Amplicon Microarray Sample Preparation.

Each sample PCR product (2 μg) will be fragmented to 50-200 bp by incubation with 0.04 Units of DNAse I (Invitrogen) for 20 min at 25° C. Following DNAse I inactivation at 98° C. for 10 min, fragment terminal labeling with biotin and hybridization to the PhyloChip will be done according to standard Affymetrix protocols and as described in Brodie et al. (Brodie E L et al., Proc Natl Acad Sci USA 2007; 104(1):299-304). Hybridization reactions will be incubated at 48° C. overnight. PhyloChip washing, and staining will be automated using the Affymetrix GeneChip Fluidics Station 450 platform and the standard protocol recommended for the PhyloChip (FlexGE-WS2v4_48_450) (Brodie E L et al., Proc Natl Acad Sci USA 2007; 104(1):299-304; Masuda N and Church G M J Bacteriol 2002; 184(22):6225-34). Each PhyloChip will be scanned with the Affymetrix GeneChip Scanner 3000 equipped with an autoloader for high-throughput processing. The resulting pixel image and initial data acquisition and probe intensity determination will be performed using standard Affymetrix software (GeneChip Microarray Analysis Suite, version 5.1). Each PCR product will be spiked prior to fragmentation with known concentration of internal standards. These internal standards are composed of a set of 15 amplicons generated from yeast and bacterial metabolic genes and will be used to account for variation from array to array. The known concentrations of the amplicons range from 4 pM to 605 pM in the final hybridization mix.

Array Data Analysis.

The barcodes placed into each pVISIA-derived plasmid will be treated by the software as OTUs (see below), enabling the routine analysis tools developed to use PhyloChip data to describe community composition to also analyze changes and differences in barcoded plasmid abundance. The PhyloChip arrays' normalized intensities data generated by the Affymetrix software will be analyzed through PhyloTrac analysis software (Brodie E L et al., Proc Natl Acad Sci USA 2007; 104(1):299-304). The pipeline incorporates background subtraction, noise calculation, and generates a list of taxa in the sample. A taxon is considered present in a sample if 92% or more of its assigned probe pairs for its corresponding probe set were positive (positive fraction >=0.92). This was determined empirically based on 16S rDNA sequencing data analysis. Hybridization intensity (referred to as intensity) is calculated in arbitrary units for each probes set as the trimmed average (maximum and minimum values removed before averaging) of the intensity of the perfect match (PM) minus mismatch (MM) probe intensity differences across the probe pairs in a given probe set. All intensities <1 are shifted to 1 to avoid errors in subsequent logarithmic transformations. Two groupings are used to describe organisms detected by the PhyloChip, the OTU (operational taxonomic unit or taxon) and the subfamily. An OTU consists of a group of one or more 16S rRNA gene sequences with typically 97% to 100% sequence homology, while a subfamily consists of a group of OTUs with typically no less than 94% sequence homology. PhyloTrac summarizes results by generating a list of both OTUs (here also barcodes) or taxa and subfamily that are present in the sample with their associated score and performs phylogenetic analyses on the datasets. PhyloTrac can reconcile and compare PhyloChip datasets with 16S rRNA gene sequences.

While the primary goal of the study will be to characterize alterations in abundance of the pVISIA chimeric clones, the relative abundance of other components of the mouse GI microbiota Will also be analyzed. One of the first steps would be an assessment of species diversity before and after inoculation using, for example, an unsupervised cluster analysis approach such as principal components analysis. Cluster analysis could be performed on raw PhyloChip data, or PhyloChip data binned into OTUs (e.g. before/after inoculation status vs OTU). Alternatively, cluster analysis may be preceded by a significance-filtering step to first establish OTUs that are significantly different between the samples obtained before and after inoculation. Measures of difference can then be used to test the "significance" of the clustering approaches. These approaches would initially be applied to data obtained at single time points after inoculation. Later, additional approaches could be used to capture the additional information available due to the time series data collection schema, for example order of colonization/loss. To this end, difference scores can be tracked over time.

Bioinformatics Analysis of PhyloChip Data.

For the analysis of the scaffolding protein-MPER chimera screen, mean signal intensity data for all array detectors for each given barcode sequence will be determined and the signal intensity normalized to the signal intensity of that barcode present in the initial inoculum. The normalized signal intensity attributable to each barcode obtained at each subsequent sampling timepoint will be determined and the intensities compared to the other normalized barcodes observed for that timepoint. A particular barcoded plasmid will be scored as screening positive if its normalized signal intensity decreases by 2 SD compared to the population of the other barcodes for that timepoint. Clones scoring positive will be subjected to further studies described below.

While the identification of clones with decreases in abundance are described here using the PhyloChip platform, this is a non-limiting example and other technologies to identify clone abundance, for example high-throughput sequencing may also be used or may be more advantageous, particularly as sequencing costs continue to decrease.

(4) Construction of Scaffolding Protein-MPER Chimeric Proteins and Screening

Library Construction

The first scaffolding protein to be used for library construction will be chosen based on the results of the initial ISIA characterization experiments. The protein that shows the least selection by the GI immune system (best persistence over time) will be selected. If several proteins show similar lack of selection, the protein that has the most diverse collection of secondary structure elements, the fewest disulfide bonds, and the least antigenic aa sequence, as assessed by several widely used tools (e.g. methods of Weiling et al, FEBS Lett 1985; 188(2):215-8, Kolaskar and Tongaonka, FEBS Lett 1990; 276(1-2):172-4, and Hopp-Woods, as implemented, e.g., in CLC Protein Work Bench) will be selected. For the initial chimeric protein library construction, bases encoding the chimeric proteins will be synthesized by iteratively inserting sequence encoding the MPER region every five aas in place of the native sequence. These DNAs will be synthesized with overhanging "sticky" ends, to enable ready ligation into the pVISIA-barcoded plasmids Fecal samples will be collected on a schedule based on the preliminary experiments comparing non-immunogenic candidate scaffolding proteins and known immunogenic proteins, choosing time points where relative selection was greatest. Samples from the inoculum administered to the mice and from fecal samples obtained at the timepoints before, at, and after the time point of maximal selection, as determined by the initial characterization experiments, will be assayed with PhyloChips, as described above. Initially, pools of 20 clones will be compared with each other in experiments. A parallel positive-control experiment with 20 clones containing chimeric scaffolding-MPER proteins and highly immunogenic protein used in the initial experiments will be conducted to ensure that we can detect a significant decrease in clone abundance in the context of the chimeric scaffolding-MPER protein expression clones.

(5) Rescreening MPER-Scaffolding Protein Chimeric Protein Constructs

Plasmids containing scaffolding protein-MPER chimeras that score positive on the initial screen will be rescreened in vivo to ensure that mucosal immune system selection actually did occur. The clones scoring positive on the initial screen will be rescreened together with 9 other clones selected because they showed the least reduction in abundance in panels of 3 mice, using the inocula and sampling schedule developed in the initial experiments. Plasmids that continue to show a greater than 2 SD decrease in abundance in the secondary in vivo screen will be selected for further study.

(6) Verification of MPER-Scaffolding Protein Construct Ability to Induce BN Anti-HIV Immune Responses Production of Test Antisera.

Scaffolding protein-MPER chimeras for which there is evidence of negative selection on repeat in vivo screen will be inoculated singly into panels of 4 mice (2 male, 2 female) in an *E coli* and/or *Salmonella* vaccine strain vector chosen during the initial optimization experiments. At this point, if the initial screen was conducted in *E coli*, the plasmid will also be transformed into *Salmonella* and also used to inoculate panels of mice in case GI immunization with the *Salmonella* vector will result in a better induction of an immune response. Blood, fecal pellets, and vaginal washes (for females) will be obtained pre-inoculation, and at time points before the time point at which the reduction in abundance was detected and two time points after, as determined in the screening experiments. Upon euthanization, maximal blood collections will also be obtained by exsanguination for the subsequent neutralization studies.

p24 Reduction Assays and Assessment of BN Anti-HIV Activity

Initially, serial dilutions of serum will be used in p24 reduction assays, conducted as described by Zwick et al (Zwick M B et al., J Virol 2001; 75(22):10892-905), but using the PerkinElmer Alliance HIV-1 p24 ELISA kit, to determine the dilution of serum required to reduce p24 production by 50%. In the initial experiments, serum from the mice will be analyzed to determine whether they can inhibit HIV infection using the lab-adapted NL4-3, JR-FL, and SF2 viruses for ease of experimentation. The serum will be compared with both negative controls (pre-immune serum) and positive controls (the 2F5 and 4E10 Mabs). To determine that the immune response was directed against MPER, competition ELISA experiments with MPER synthetic peptide will be conduct as described (Zwick M B et al., J Virol 2001; 75(22):10892-905). If the serum does prove capable of reducing p24 in the lab strains, it will be tested for BN activity against a panel of viruses representative of each clade A-D, NSI and SI, from the standardized pools of international isolates (Brown B K et al., J Virol 2005; 79(10):6089-101), available from the AIDS Reference Reagent Program. If BN activity is present, a larger panel of viruses may be examined. Larger animals (e.g. rabbits) may be immunized to produce larger stocks of antisera for subsequent immunological characterization studies. Mabs may also be produced following immunization with the bacteria expressing the scaffolding protein-MPER chimeric construct.

Although various specific embodiments and examples have been described herein, those having ordinary skill in the art will understand that many different implementations of the invention can be achieved without departing from the spirit or scope of this disclosure.

SEQUENCE LISTING

```
<160> NUMBER OF SEQ ID NOS: 11

<210> SEQ ID NO 1
<211> LENGTH: 7316
<212> TYPE: DNA
<213> ORGANISM: artificial
<220> FEATURE:
<223> OTHER INFORMATION: plasmid

<400> SEQUENCE: 1

actccgcgca catttccccg aaaagtgcca cctccgcggg acgtctaaga aaccattatt     60
```

-continued

```
atcatgacat taacctataa aaataggcgt atcacgaggc acgcgtcctt tcgtcctcaa    120
gaattctcat gtttgacagc ttatcatcga taagctttaa tgcggtagtt tatcacagtt    180
aaattgctaa cgcagtcagg caccgtgtat gaaatctaac aatgcgctca tcgtcatcct    240
cggcaccgtc accctggatg ctgtaggcat aggcttggtt atgccggtac tgccgggcct    300
cttgcgggat atcgtccatt ccgacagcat cgccagtcac tatggcgtgc tgctagcgct    360
atatgcgttg atgcaatttc tatgcgcacc cgttctcgga gcactgtccg accgctttgg    420
ccgccgccca gtcctgctcg cttcgctact tggagccact atcgactacg cgatcatggc    480
gaccacaccc gtcctgtgga tcctctacgc cggacgcatc gtggccggca tcaccggcgc    540
cacaggtgcg gttgctggcg cctatatcgc cgacatcacc gatggggaag atcgggctcg    600
ccacttcggg ctcatgagcg cttgtttcgg cgtgggtatg gtggcaggcc ccgtggccgg    660
gggactgttg ggcgccatct ccttgcatgc accattcctt gcggcggcgg tgctcaacgg    720
cctcaaccta ctactgggct gcttcctaat gcaggagtcg cataagggag agcgtcgacc    780
gatgcccttg agagccttca acccagtcag ctccttccgg tgggcgcggg gcatgactat    840
cgtcgccgca cttatgactg tgttctttat catgcaactc gtaggacagg tgccggcagc    900
gctctgggtc attttcggcg aggaccgctt tcgctggagc gcgacgatga tcggcctgtc    960
gcttgcggta ttcggaatct tgcacgccct cgctcaagcc ttcgtcactg gtcccgccac   1020
caaacgtttc ggcgagaagc aggccattat cgccggcatg gcggccgacg cgctgggcta   1080
cgtcttgctg gcgttcgcga cgcgaggctg gatggccttc cccattatga ttcttctcgc   1140
ttccggcggc atcgggatgc ccgcgttgca ggccatgctg tccaggcagg tagatgacga   1200
ccatcaggga cagcttcaag gatcgctcgc ggctcttacc agcctaactt cgatcattgg   1260
accgctgatc gtcacggcga tttatgccgc ctcggcgagc acatggaacg ggttggcatg   1320
gattgtaggc gccgccctat accttgtctg cctccccgcg ttgcgtcgcg gtgcatggag   1380
ccgggccacc tcgacctgat aatagatcga tacgcgtatg gaagccggcg gcacctcgct   1440
aacggattca ccactccaag aattggagcc aatcaattct tgcggagaac tgtgaatgcg   1500
caaaccaacc cttggcagaa catatccatc gcgtccgcca tctccagcag ccgcacgcgg   1560
cgcatctcgg gcagcgttgg gtcctggcca cgggtgcgca tgatcgtgct cctgtcctcg   1620
tgatacgcct atttttatag gttaatgtca tgataataat ggtttcttag acgtcaggtg   1680
gcacttttcg gggaaatgtg cgcggaaccc ctatttgttt atttttctaa atacattcaa   1740
atatgtatcc gctcatgaga caataaccct gataaatgct tcaataatat tgaaaaagga   1800
agagtatgat taaattaaaa tttggtgttt tttttacagt tttactatct tcagcatatg   1860
cacatggaac acctcaaaat attactcacg gtgtgttaac cctgtcttct cgtggtctgg   1920
actatccata cgatgtaccg gattacgcgc gttatggaag acgagtgtta accatggaga   1980
tcttcgaact taatcctaca aaagaaagtg caggtaatac tcttaccgtg tcaaattata   2040
ctgggacacc gggaagtgtt atttctcttg gtggtgtgct tgaaggagat aattcactta   2100
cggaccgtct ggtggtgaaa ggtaatacct ctggtcaaag tgacatcgtt tatgtcaatg   2160
aagatggcag tggtggtcag acgagagatg gtattaatat tatttctgta gagggaaatt   2220
ctgatgcaga attctctctg aagaaccgcg tagttgccgg agcttatgat tacacactgc   2280
agaaaggaaa cgagagtggg acagataata agggatggta tttaaccagt catcttccca   2340
catctgatac ccggcaatac agaccggaga acggaagtta tgctaccaat atggcactgg   2400
ctaactcact gttcctcatg gatttgaatg agcgtaagca attcagggcc atgagtgata   2460
```

atacacagcc tgagtctgca tccgtgtgga tgaagatcac tggaggaata agctctggta 2520
agcttaatga cgggcaaaat aaaacaacaa ccaatcagtt tatcaatcag ctcgggggg 2580
atatttataa attccatgct gaacaactgg gtgattttac cttagggatt atgggaggat 2640
acgcgaatgc aaaaggtaaa acgataaatt acacgagcaa caaagctgcc agaaacacac 2700
tggatggtta ttctgtcggg gtatacggta cgtggtatca gaatggggaa aatgcaacag 2760
ggctctttgc tgaaacttgg atgcaatata actggtttaa tgcatcagtg aaaggtgacg 2820
gactggaaga agaaaaatat aatctgaatg gtttaaccgc ttctgcaggt gggggatata 2880
acctgaatgt gcacacatgg acatcacctg aaggaataac aggtgaattc tggttacagc 2940
ctcatttgca ggctgtctgg atgggggtta caccggatac acatcaggag gataacggaa 3000
cggtggtgca gggagcaggg aaaaataata ttcagacaaa agcaggtatt cgtgcatcct 3060
ggaaggtgaa aagcaccctg gataaggata ccgggcggag gttccgtccg tatatagagg 3120
caaactggat ccataacact catgaatttg gtgttaaaat gagtgatgac agccagttgt 3180
tgtcaggtag ccgaaatcag ggagagataa agacaggtat tgaaggggtg attactcaaa 3240
acttgtcagt gaatggcgga gtcgcatatc aggcaggagg tcacgggagc aatgccatct 3300
ccggagcact ggggataaaa tacagcttct gataatagta cctgtgaagt gaaaaatggc 3360
gcacattgcg cgacattttt tttgtctgcc gtttaccgca cagatgcgta aggagaaaat 3420
accgcatcag gcgctcttcc gcttcctcgc tcactgactc gctgcgctcg gtcgttcggc 3480
tgcggcgagc ggtatcagct cactcaaaag cttggctgtc tcaggtttgt tcctgattgg 3540
ttacggcgcg tttcgcatca ttgttgagtt tttccgccag cccgacgcgc agtttaccgg 3600
tgcctgggtg cagtacatca gcatggggca aattctttcc atcccgatga ttgtcgcggg 3660
tgtgatcatg atggtctggg catatcgtcg cagcccacag caacacgttt cctgaggaac 3720
catgaaacag tatttagaac tgatgcaaaa agtgctcgac gaaggcacac agaaaaacga 3780
ccgtaccgga accggaacgc tttccatttt tggtcatcag atgcgtttta acctgcaaga 3840
tggattcccg ctggtgacaa ctaaacgttg ccacctgcgt tccatcatcc atgaactgct 3900
gtggtttctg cagggcgaca ctaacattgc ttatctacac gaaaacaatg tcaccatctg 3960
ggacgaatgg gccgatgaaa acggcgacct cgggccagtg tatggtaaac agtggcgcgc 4020
ctggccaacg ccagatggtc gtcatattga ccagatcact acggtactga accagctgaa 4080
aaacgacccg gattcgcgcc gcattattgt ttcagcgtgg aacgtaggcg aactggataa 4140
aatggcgctg gcaccgtgcc atgcattctt ccagttctat gtggcagacg gcaaactctc 4200
ttgccagctt tatcagcgct cctgtgacgt gttcctcggc ctgccgttca acattgccag 4260
ctacgcatta ttggtgcata tgatggcgca gcagtgcgat ctggaagtgg gtgattttgt 4320
ctggaccggt ggcgacacgc atctgtacag caaccatatg gatcaaactc atctgcaatt 4380
aagccgcgaa ccgcgtccgc tgccgaagtt gattatcaaa cgtaaacccg aatccatctt 4440
cgactaccgt ttcgaagatt ttgagattga aggctacgat ccgcatccgg gcattaaagc 4500
gccggtggct atctaattac gaaacatcct gccagagccg acgccagtgt gcgtcggttt 4560
ttttaccctc cgttaaattc ttcgatccgc cttcccgaaa ttttgcaacg tcctgcaacg 4620
gcgtaaatag tccggaagat gcgccgaaga aatagaaact ggccaagctt cgcccgggca 4680
ggaaagaaca tgtttaatta acgccgagac cttatattcc ccagaacatc aggttaatgg 4740
cgtttttgat gtcattttcg cggtggctga gatcagccac ttcttccccg ataacggaaa 4800

-continued

```
ccggcacact ggccatatcg gtggtcatca tgcgccagct ttcatccccg atatgcacca   4860
ccgggtaaag ttcacgggag actttatctg acagcagacg tgcactggcc agggggatca   4920
ccatccgtcg cccgggcgtg tcaataatat cactctgtac atccacaaac agacgataac   4980
ggctctctct tttataggtg taaaccttaa actgcatttc accagcccct gttctcgtca   5040
gcaaaagagc cgttcatttc aataaaccgg gcgacctcag ccatcccttc ctgattttcc   5100
gctttccagc gttcggcacg cagacgacgg gcttcattct gcatggttgt gcttaccaga   5160
ccggagatat tgacatcata tatgccttga gcaactgata gctgtcgctg tcaactgtca   5220
ctgtaatacg ctgcttcata gcatacctct ttttgacata cttcgggtat acatatcagt   5280
atatattctt ataccgcaaa aatcagcgcg caaatatgca tactgttatc tggcttttag   5340
taagccggtc tcaggattaa ttaagagcaa aaggccagcc ctaggaaaaa ggcggtaata   5400
cggttatcca cagaatcagg ggataacgca ggaaagaaca tgtgagcaaa aggccagcaa   5460
aaggccagga accgtaaaaa ggccgcgttg ctggcgtttt tccataggct ccgcccccct   5520
gacgagcatc acaaaaatcg acgctcaagt cagaggtggc gaaacccgac aggactataa   5580
agataccagg cgtttccccc tggaagctcc ctcgtgcgct ctcctgttcc gaccctgccg   5640
cttaccggat acctgtccgc ctttctccct tcgggaagcg tggcgctttc tcatagctca   5700
cgctgtaggt atctcagttc ggtgtaggtc gttcgctcca agctgggctg tgtgcacgaa   5760
ccccccgttc agcccgaccg ctgcgcctta tccggtaact atcgtcttga gtccaacccg   5820
gtaagacacg acttatcgcc actggcagca gccactggta acaggattag cagagcgagg   5880
tatgtaggcg gtgctacaga gttcttgaag tggtgggcta actacggcta cactagaaga   5940
acagtatttg gtatctgcgc tctgctgaag ccagttacct tcggaaaaag agttggtagc   6000
tcttgatccg gcaaacaaac caccgctggt agcggtggtt tttttgtttg caagcagcag   6060
attacgcgca gaaaaaaagg atctcaagaa gatcctttga tcttttctac ggggtctgac   6120
gctcagtgga acgacgcgcg cgtaactcac gttaagggat tttggtcatg agattatcaa   6180
aaaggatctt cacctagatc cttttaaatt aaaaatgaag ttttaaatca atctaaagta   6240
tatatgagta aacttgatct ccgcgggacg tcgacagtta ccaatgctta atcagtgagg   6300
cacctatctc agcgatctgt ctatttcgtt catccatagt tgcctgactc cccgtcgtgt   6360
agataactac gatacgggag ggcttaccat ctggccccag cgctgcgatg ataccgcgag   6420
aaccacgctc accggctccg gatttatcag caataaacca gccagccgga agggccgagc   6480
gcagaagtgg tcctgcaact ttatccgcct ccatccagtc tattaattgt tgccgggaag   6540
ctagagtaag tagttcgcca gttaatagtt tgcgcaacgt tgttgccatc gctacaggca   6600
tcgtggtgtc acgctcgtcg tttggtatgg cttcattcag ctccggttcc caacgatcaa   6660
ggcgagttac atgatccccc atgttgtgca aaaaagcggt tagctccttc ggtcctccga   6720
tcgttgtcag aagtaagttg gccgcagtgt tatcactcat ggttatggca gcactgcata   6780
attctcttac tgtcatgcca tccgtaagat gcttttctgt gactggtgag tactcaacca   6840
agtcattctg agaatagtgt atgcggcgac cgagttgctc ttgcccggcg tcaatacggg   6900
ataataccgc gccacatagc agaactttaa aagtgctcat cattggaaaa cgttcttcgg   6960
ggcgaaaact ctcaaggatc ttaccgctgt tgagatccag ttcgatgtaa cccactcgtg   7020
cacccaactg atcttcagca tcttttactt tcaccagcgt ttctgggtga gcaaaaacag   7080
gaaggcaaaa tgccgcaaaa aagggaataa gggcgacacg gaaatgttga atactcatat   7140
tcttcctttt tcaatattat tgaagcattt atcagggtta ttgtctcatg agcggataca   7200
```

```
tatttgaatg tatttagaaa aataaacaaa taggggtcag tgttacaacc aattaaccaa   7260

ttctgaacat tatcgcgagc ccatttatac ctgaatatgg ctcataacac cccttg       7316


<210> SEQ ID NO 2
<211> LENGTH: 1163
<212> TYPE: DNA
<213> ORGANISM: E coli

<400> SEQUENCE: 2

aagcttggct gtctcaggtt tgttcctgat tggttacggc gcgtttcgca tcattgttga     60

gtttttccgc cagcccgacg cgcagtttac cggtgcctgg gtgcagtaca tcagcatggg    120

gcaaattctt tccatcccga tgattgtcgc gggtgtgatc atgatggtct gggcatatcg    180

tcgcagccca cagcaacacg tttcctgagg aaccatgaaa cagtatttag aactgatgca    240

aaaagtgctc gacgaaggca cacagaaaaa cgaccgtacc ggaaccggaa cgctttccat    300

ttttggtcat cagatgcgtt ttaacctgca agatggattc ccgctggtga caactaaacg    360

ttgccacctg cgttccatca tccatgaact gctgtggttt ctgcagggcg acactaacat    420

tgcttatcta cacgaaaaca atgtcaccat ctgggacgaa tgggccgatg aaaacggcga    480

cctcgggcca gtgtatggta aacagtggcg cgcctggcca acgccagatg gtcgtcatat    540

tgaccagatc actacggtac tgaaccagct gaaaaacgac ccggattcgc gccgcattat    600

tgtttcagcg tggaacgtag gcgaactgga taaaatggcg ctggcaccgt gccatgcatt    660

cttccagttc tatgtggcag acggcaaact ctcttgccag ctttatcagc gctcctgtga    720

cgtgttcctc ggcctgccgt tcaacattgc cagctacgca ttattggtgc atatgatggc    780

gcagcagtgc gatctggaag tgggtgattt tgtctggacc ggtggcgaca cgcatctgta    840

cagcaaccat atggatcaaa ctcatctgca attaagccgc gaaccgcgtc cgctgccgaa    900

gttgattatc aaacgtaaac ccgaatccat cttcgactac cgtttcgaag attttgagat    960

tgaaggctac gatccgcatc cgggcattaa agcgccggtg gctatctaat tacgaaacat   1020

cctgccagag ccgacgccag tgtgcgtcgg tttttttacc ctccgttaaa ttcttcgatc   1080

cgccttcccg aaattttgca acgtcctgca acggcgtaaa tagtccggaa gatgcgccga   1140

agaaatagaa actggccaag ctt                                           1163


<210> SEQ ID NO 3
<211> LENGTH: 1590
<212> TYPE: DNA
<213> ORGANISM: artificial
<220> FEATURE:
<223> OTHER INFORMATION: plasmid sequence

<400> SEQUENCE: 3

attaaattaa aatttggtgt ttttttaca gttttactat cttcagcata tgcacatgga     60

acacctcaaa atattactca cggtgtgtta accctgtctt ctcgtggtct ggactatcca    120

tacgatgtac cggattacgc gcgttatgga agacgagtgt taaccatgga gatcttcgaa    180

cttaatccta caaaagaaag tgcaggtaat actcttaccg tgtcaaatta tactgggaca    240

ccgggaagtg ttatttctct tggtggtgtg cttgaaggag ataattcact tacggaccgt    300

ctggtggtga aaggtaatac ctctggtcaa agtgacatcg tttatgtcaa tgaagatggc    360

agtggtggtc agacgagaga tggtattaat attatttctg tagagggaaa ttctgatgca    420

gaattctctc tgaagaaccg cgtagttgcc ggagcttatg attacacact gcagaaagga    480
```

```
aacgagagtg ggacagataa taagggatgg tatttaacca gtcatcttcc cacatctgat    540

acccggcaat acagaccgga gaacggaagt tatgctacca atatggcact ggctaactca    600

ctgttcctca tggatttgaa tgagcgtaag caattcaggg ccatgagtga taatacacag    660

cctgagtctg catccgtgtg gatgaagatc actggaggaa taagctctgg taagcttaat    720

gacgggcaaa ataaaacaac aaccaatcag tttatcaatc agctcggggg ggatatttat    780

aaattccatg ctgaacaact gggtgatttt accttaggga ttatgggagg atacgcgaat    840

gcaaaaggta aaacgataaa ttacacgagc aacaaagctg ccagaaacac actggatggt    900

tattctgtcg gggtatacgg tacgtggtat cagaatgggg aaaatgcaac agggctcttt    960

gctgaaactt ggatgcaata taactggttt aatgcatcag tgaaaggtga cggactggaa   1020

gaagaaaaat ataatctgaa tggtttaacc gcttctgcag gtgggggata taacctgaat   1080

gtgcacacat ggacatcacc tgaaggaata acaggtgaat tctggttaca gcctcatttg   1140

caggctgtct ggatgggggt tacaccggat acacatcagg aggataacgg aacggtggtg   1200

cagggagcag ggaaaaataa tattcagaca aaagcaggta ttcgtgcatc ctggaaggtg   1260

aaaagcaccc tggataagga taccgggcgg aggttccgtc cgtatataga ggcaaactgg   1320

atccataaca ctcatgaatt tggtgttaaa atgagtgatg acagccagtt gttgtcaggt   1380

agccgaaatc agggagagat aaagacaggt attgaagggg tgattactca aaacttgtca   1440

gtgaatggcg gagtcgcata tcaggcagga ggtcacggga gcaatgccat ctccggagca   1500

ctggggataa aatacagctt ctgataatag tacctgtgaa gtgaaaaatg gcgcacattg   1560

cgcgacattt tttttgtctg ccgtttaccg                                    1590
```

<210> SEQ ID NO 4
<211> LENGTH: 8137
<212> TYPE: DNA
<213> ORGANISM: artificial
<220> FEATURE:
<223> OTHER INFORMATION: plasmid

<400> SEQUENCE: 4

```
ttctcatgtt tgacagctta tcatcgataa gctttaatgc ggtagtttat cacagttaaa     60

ttgctaacgc agtcaggcac cgtgtatgaa atctaacaat gcgctcatcg tcatcctcgg    120

caccgtcacc ctggatgctg taggcatagg cttggttatg ccggtactgc cgggcctctt    180

gcgggatatc gtccattccg acagcatcgc cagtcactat ggcgtgctgc tagcgctata    240

tgcgttgatg caatttctat gcgcacccgt tctcggagca ctgtccgacc gctttggccg    300

ccgcccagtc ctgctcgctt cgctacttgg agccactatc gactacgcga tcatggcgac    360

cacacccgtc ctgtggatcc tctacgccgg acgcatcgtg gccggcatca ccggcgccac    420

aggtgcggtt gctggcgcct atatcgccga catcaccgat ggggaagatc gggctcgcca    480

cttcgggctc atgagcgctt gtttcggcgt gggtatggtg gcaggccccg tggccggggg    540

actgttgggc gccatctcct tgcatgcacc attccttgcg gcggcggtgc tcaacggcct    600

caacctacta ctgggctgct tcctaatgca ggagtcgcat aagggagagc gtcgaccgat    660

gcccttgaga gccttcaacc cagtcagctc cttccggtgg gcgcggggca tgactatcgt    720

cgccgcactt atgactgtgt tctttatcat gcaactcgta ggacaggtgc cggcagcgct    780

ctgggtcatt ttcggcgagg accgctttcg ctggagcgcg acgatgatcg gcctgtcgct    840

tgcggtattc ggaatcttgc acgccctcgc tcaagccttc gtcactggtc ccgccaccaa    900

acgtttcggc gagaagcagg ccattatcgc cggcatggcg gccgacgcgc tgggctacgt    960
```

```
cttgctggcg ttcgcgacgc gaggctggat ggccttcccc attatgattc ttctcgcttc   1020
cggcggcatc gggatgcccg cgttgcaggc catgctgtcc aggcaggtag atgacgacca   1080
tcagggacag cttcaaggat cgctcgcggc tcttaccagc ctaacttcga tcattggacc   1140
gctgatcgtc acggcgattt atgccgcctc ggcgagcaca tggaacgggt tggcatggat   1200
tgtaggcgcc gccctatacc ttgtctgcct ccccgcgttg cgtcgcggtg catggagccg   1260
ggccacctcg acctgataat agatcgatac gcgtatggaa gccggcggca cctcgctaac   1320
ggattcacca ctccaagaat tggagccaat caattcttgc ggagaactgt gaatgcgcaa   1380
accaaccctt ggcagaacat atccatcgcg tccgccatct ccagcagccg cacgcggcgc   1440
atctcgggca gcgttgggtc ctggccacgg gtgcgcatga tcgtgctcct gtcgataacc   1500
agaagcaata aaaaatcaaa tcggatttca ctatataatc tcactttatc taagatgaat   1560
ccgatggaag catcctgttt tctctcaatt tttttatcta aaacccagcg ttcgatgctt   1620
ctttgagcga acgatcaaaa ataagtgcct tcccatcaaa aaaatattga caacataaaa   1680
aactttgtgt tatacttgta acgctacatg gagattaact caatctagag ggtattaata   1740
atgattaaat taaaatttgg tgtttttttt acagttttac tatcttcagc atatgcacat   1800
ggaacacctc aaaatattac tcacggtgtg ttaaccctgt cttcttagaa aaactcatcg   1860
agcatcaaat gaaactgcaa tttattcata tcaggattat caataccata tttttgaaaa   1920
agccgtttct gtaatgaagg agaaaactca ccgaggcagt tccataggat ggcaagatcc   1980
tggtatcggt ctgcgattcc gactcgtcca acatcaatac aacctattaa tttcccctcg   2040
tcaaaaataa ggttatcaag tgagaaatca ccatgagtga cgactgaatc cggtgagaat   2100
ggcaaaagtt tatgcatttc tttccagact tgttcaacag gccagccatt acgctcgtca   2160
tcaaaatcac tcgcatcaac caaaccgtta ttcattcgtg attgcgcctg agcgaggcga   2220
aatacgcgat cgctgttaaa aggacaatta caaacaggaa tcgagtgcaa ccggcgcagg   2280
aacactgcca gcgcatcaac aatattttca cctgaatcag gatattcttc taatacctgg   2340
aacgctgttt ttccggggat cgcagtggtg agtaaccatg catcatcagg agtacggata   2400
aaatgcttga tggtcggaag tggcataaat tccgtcagcc agtttagtct gaccatctca   2460
tctgtaacat cattggcaac gctacctttg ccatgtttca gaaacaactc tggcgcatcg   2520
ggcttcccat acaagcgata gattgtcgca cctgattgcc cgacattatc gcgagcccat   2580
ttatacccat ataaatcagc atccatgttg gaatttaatc gcggcctcga cgtttcccgt   2640
tgaatatggc tcatgaagac gagtgttaac catggagatc ttcgaactta atcctacaaa   2700
agaaagtgca ggtaatactc ttaccgtgtc aaattatact gggacaccgg gaagtgttat   2760
ttctcttggt ggtgtgcttg aaggagataa ttcacttacg gaccgtctgg tggtgaaagg   2820
taatacctct ggtcaaagtg acatcgttta tgtcaatgaa gatggcagtg gtggtcagac   2880
gagagatggt attaatatta tttctgtaga gggaaattct gatgcagaat tctctctgaa   2940
gaaccgcgta gttgccggag cttatgatta cacactgcag aaaggaaacg agagtgggac   3000
agataataag ggatggtatt taaccagtca tcttcccaca tctgataccc ggcaatacag   3060
accggagaac ggaagttatg ctaccaatat ggcactggct aactcactgt tcctcatgga   3120
tttgaatgag cgtaagcaat tcagggccat gagtgataat acacagcctg agtctgcatc   3180
cgtgtggatg aagatcactg gaggaataag ctctggtaag cttaatgacg ggcaaaataa   3240
aacaacaacc aatcagttta tcaatcagct cgggggggat atttataaat tccatgctga   3300
```

acaactgggt gattttacct tagggattat gggaggatac gcgaatgcaa aaggtaaaac 3360
gataaattac acgagcaaca aagctgccag aaacacactg gatggttatt ctgtcggggt 3420
atacggtacg tggtatcaga atggggaaaa tgcaacaggg ctctttgctg aaacttggat 3480
gcaatataac tggtttaatg catcagtgaa aggtgacgga ctggaagaag aaaaatataa 3540
tctgaatggt ttaaccgctt ctgcaggtgg gggatataac ctgaatgtgc acacatggac 3600
atcacctgaa ggaataacag gtgaattctg gttacagcct catttgcagg ctgtctggat 3660
gggggttaca ccggatacac atcaggagga taacggaacg gtggtgcagg gagcagggaa 3720
aaataatatt cagacaaaag caggtattcg tgcatcctgg aaggtgaaaa gcaccctgga 3780
taaggatacc gggcggaggt tccgtccgta tatagaggca aactggatcc ataacactca 3840
tgaatttggt gttaaaatga gtgatgacag ccagttgttg tcaggtagcc gaaatcaggg 3900
agagataaag acaggtattg aaggggtgat tactcaaaac ttgtcagtga atggcggagt 3960
cgcatatcag gcaggaggtc acgggagcaa tgccatctcc ggagcactgg ggataaaata 4020
cagcttctga taatagtacc tgtgaagtga aaaatggcgc acattgcgcg acatttttt 4080
tgtctgccgt ttaccgcaca gatgcgtaag gagaaaatac cgcatcaggc gctcttccgc 4140
ttcctcgctc actgactcgc tgcgctcggt cgttcggctg cggcgagcgg tatcagctca 4200
ctcaaaagct tggctgtctc aggtttgttc ctgattggtt acggcgcgtt tcgcatcatt 4260
gttgagtttt tccgccagcc cgacgcgcag tttaccggtg cctgggtgca gtacatcagc 4320
atggggcaaa ttctttccat cccgatgatt gtcgcgggtg tgatcatgat ggtctgggca 4380
tatcgtcgca gcccacagca acacgtttcc tgaggaacca tgaaacagta tttagaactg 4440
atgcaaaaag tgctcgacga aggcacacag aaaaacgacc gtaccggaac cggaacgctt 4500
tccatttttg gtcatcagat gcgttttaac ctgcaagatg gattcccgct ggtgacaact 4560
aaacgttgcc acctgcgttc catcatccat gaactgctgt ggtttctgca gggcgacact 4620
aacattgctt atctacacga aaacaatgtc accatctggg acgaatgggc cgatgaaaac 4680
ggcgacctcg ggccagtgta tggtaaacag tggcgcgcct ggccaacgcc agatggtcgt 4740
catattgacc agatcactac ggtactgaac cagctgaaaa acgacccgga ttcgcgccgc 4800
attattgttt cagcgtggaa cgtaggcgaa ctggataaaa tggcgctggc accgtgccat 4860
gcattcttcc agttctatgt ggcagacggc aaactctctt gccagcttta tcagcgctcc 4920
tgtgacgtct tcctcggcct gccgttcaac attgccagct acgcgttatt ggtgcatatg 4980
atggcgcagc agtgcgatct ggaagtgggt gattttgtct ggaccggtgg cgacacgcat 5040
ctgtacagca accatatgga tcaaactcat ctgcaattaa gccgcgaacc gcgtccgctg 5100
ccgaagttga ttatcaaacg taaacccgaa tccatcttcg actaccgttt cgaagacttt 5160
gagattgaag gctacgatcc gcatccgggc attaaagcgc cggtggctat ctaattacga 5220
aacatcctgc cagagccgac gccagtgtgc gtcggttttt ttaccctccg ttaaattctt 5280
cgagacgcct tcccgaaatt ttgcaacgtc ctgcaacggc gtaaatagtc cggaagatgc 5340
gccgaagaaa tagaaactgg ccaagcttcg cccgggcagg aaagaacatg tttaattaac 5400
gccgagacct tatattcccc agaacatcag gttaatggcg tttttgatgt cattttcgcg 5460
gtggctgaga tcagccactt cttccccgat aacggaaacc ggcacactgg ccatatcggt 5520
ggtcatcatg cgccagcttt catccccgat atgcaccacc gggtaaagtt cacgggagac 5580
tttatctgac agcagacgtg cactggccag ggggatcacc atccgtcgcc cgggcgtgtc 5640
aataatatca ctctgtacat ccacaaacag acgataacgg ctctctcttt tataggtgta 5700

```
aaccttaaac tgcatttcac cagcccctgt tctcgtcagc aaaagagccg ttcatttcaa   5760
taaaccgggc gacctcagcc atcccttcct gattttccgc tttccagcgt tcggcacgca   5820
gacgacgggc ttcattctgc atggttgtgc ttaccagacc ggagatattg acatcatata   5880
tgccttgagc aactgatagc tgtcgctgtc aactgtcact gtaatacgct gcttcatagc   5940
atacctcttt ttgacatact tcgggtatac atatcagtat atattcttat accgcaaaaa   6000
tcagcgcgca aatacgcata ctgttatctg gcttttagta agccggtctc aggattaatt   6060
aagagcaaaa ggccagccct aggaaaaagg cggtaatacg gttatccaca gaatcagggg   6120
ataacgcagg aaagaacatg tgagcaaaag gccagcaaaa ggccaggaac cgtaaaaagg   6180
ccgcgttgct ggcgtttttc cataggctcc gcccccctga cgagcatcac aaaaatcgac   6240
gctcaagtca gaggtggcga aacccgacag gactataaag ataccaggcg tttccccctg   6300
gaagctccct cgtgcgctct cctgttccga ccctgccgct taccggatac ctgtccgcct   6360
ttctcccttc gggaagcgtg gcgctttctc atagctcacg ctgtaggtat ctcagttcgg   6420
tgtaggtcgt tcgctccaag ctgggctgtg tgcacgaacc ccccgttcag cccgaccgct   6480
gcgccttatc cggtaactat cgtcttgagt ccaacccggt aagacacgac ttatcgccac   6540
tggcagcagc cactggtaac aggattagca gagcgaggta tgtaggcggt gctacagagt   6600
tcttgaagtg gtgggctaac tacggctaca ctagaagaac agtatttggt atctgcgctc   6660
tgctgaagcc agttaccttc ggaaaaagag ttggtagctc ttgatccggc aaacaaacca   6720
ccgctggtag cggtggtttt tttgtttgca agcagcagat tacgcgcaga aaaaaaggat   6780
ctcaagaaga tcctttgatc ttttctacgg ggtctgacgc tcagtggaac gacgcgcgcg   6840
taactcacgt taagggattt tggtcatgag attatcaaaa aggatcttca cctagatcct   6900
tttaaattaa aaatgaagtt ttaaatcaat ctaaagtata tatgagtaaa cttgatctcc   6960
gcgggacgtc gacagttacc aatgcttaat cagtgaggca cctatctcag cgatctgtct   7020
atttcgttca tccatagttg cctgactccc cgtcgtgtag ataactacga tacgggaggg   7080
cttaccatct ggccccagcg ctgcgatgat accgcgagaa ccacgctcac cggctccgga   7140
tttatcagca ataaaccagc cagccggaag ggccgagcgc agaagtggtc ctgcaacttt   7200
atccgcctcc atccagtcta ttaattgttg ccgggaagct agagtaagta gttcgccagt   7260
taatagtttg cgcaacgttg ttgccatcgc tacaggcatc gtggtgtcac gctcgtcgtt   7320
tggtatggct tcattcagct ccggttccca acgatcaagg cgagttacat gatcccccat   7380
gttgtgcaaa aaagcggtta gctccttcgg tcctccgatc gttgtcagaa gtaagttggc   7440
cgcagtgtta tcactcatgg ttatggcagc actgcataat tctcttactg tcatgccatc   7500
cgtaagatgc ttttctgtga ctggtgagta ctcaaccaag tcattctgag aatagtgtat   7560
gcggcgaccg agttgctctt gcccggcgtc aatacgggat aataccgcgc cacatagcag   7620
aactttaaaa gtgctcatca ttggaaaacg ttcttcgggg cgaaaactct caaggatctt   7680
accgctgttg agatccagtt cgatgtaacc cactcgtgca cccaactgat cttcagcatc   7740
ttttactttc accagcgttt ctgggtgagc aaaaacagga aggcaaaatg ccgcaaaaaa   7800
gggaataagg gcgacacgga aatgttgaat actcatattc ttcctttttc aatattattg   7860
aagcatttat cagggttatt gtctcatgag cggatacata tttgaatgta tttagaaaaa   7920
taaacaaata ggggtcagtg ttacaaccaa ttaaccaatt ctgaacatta tcgcgagccc   7980
atttatacct gaatatggct cataacaccc cttgactccg cgcacatttc cccgaaaagt   8040
```

```
gccacctccg cgggacgtct aagaaaccat tattatcatg acattaacct ataaaaatag   8100

gcgtatcacg aggcacgcgt cctttcgtcc tcaagaa                            8137


<210> SEQ ID NO 5
<211> LENGTH: 2353
<212> TYPE: DNA
<213> ORGANISM: artificial
<220> FEATURE:
<223> OTHER INFORMATION: plasmid sequence

<400> SEQUENCE: 5

ttaaattaaa atttggtgtt ttttttacag ttttactatc ttcagcatat gcacatggaa     60

cacctcaaaa tattactcac ggtgtgttaa ccctgtcttc ttagaaaaac tcatcgagca    120

tcaaatgaaa ctgcaattta ttcatatcag gattatcaat accatatttt tgaaaaagcc    180

gtttctgtaa tgaaggagaa aactcaccga ggcagttcca taggatggca agatcctggt    240

atcggtctgc gattccgact cgtccaacat caatacaacc tattaatttc ccctcgtcaa    300

aaataaggtt atcaagtgag aaatcaccat gagtgacgac tgaatccggt gagaatggca    360

aaagtttatg catttctttc cagacttgtt caacaggcca gccattacgc tcgtcatcaa    420

aatcactcgc atcaaccaaa ccgttattca ttcgtgattg cgcctgagcg aggcgaaata    480

cgcgatcgct gttaaaagga caattacaaa caggaatcga gtgcaaccgg cgcaggaaca    540

ctgccagcgc atcaacaata ttttcacctg aatcaggata ttcttctaat acctggaacg    600

ctgtttttcc ggggatcgca gtggtgagta accatgcatc atcaggagta cggataaaat    660

gcttgatggt cggaagtggc ataaattccg tcagccagtt tagtctgacc atctcatctg    720

taacatcatt ggcaacgcta cctttgccat gtttcagaaa caactctggc gcatcgggct    780

tcccatacaa gcgatagatt gtcgcacctg attgcccgac attatcgcga gcccatttat    840

acccatataa atcagcatcc atgttggaat ttaatcgcgg cctcgacgtt tcccgttgaa    900

tatggctcat gaagacgagt gttaaccatg gagatcttcg aacttaatcc tacaaaagaa    960

agtgcaggta atactcttac cgtgtcaaat tatactggga caccgggaag tgttatttct   1020

cttggtggtg tgcttgaagg agataattca cttacggacc gtctggtggt gaaaggtaat   1080

acctctggtc aaagtgacat cgtttatgtc aatgaagatg gcagtggtgg tcagacgaga   1140

gatggtatta atattatttc tgtagaggga aattctgatg cagaattctc tctgaagaac   1200

cgcgtagttg ccggagctta tgattacaca ctgcagaaag gaaacgagag tgggacagat   1260

aataagggat ggtatttaac cagtcatctt cccacatctg atacccggca atacagaccg   1320

gagaacggaa gttatgctac caatatggca ctggctaact cactgttcct catggatttg   1380

aatgagcgta agcaattcag ggccatgagt gataatacac agcctgagtc tgcatccgtg   1440

tggatgaaga tcactggagg aataagctct ggtaagctta atgacgggca aaataaaaca   1500

acaaccaatc agtttatcaa tcagctcggg ggggatattt ataaattcca tgctgaacaa   1560

ctgggtgatt ttaccttagg gattatggga ggatacgcga atgcaaaagg taaaacgata   1620

aattacacga gcaacaaagc tgccagaaac acactggatg gttattctgt cggggtatac   1680

ggtacgtggt atcagaatgg ggaaaatgca acagggctct ttgctgaaac ttggatgcaa   1740

tataactggt ttaatgcatc agtgaaaggt gacggactgg aagaagaaaa atataatctg   1800

aatggtttaa ccgcttctgc aggtggggga tataacctga atgtgcacac atggacatca   1860

cctgaaggaa taacaggtga attctggtta cagcctcatt tgcaggctgt ctggatgggg   1920

gttacaccgg atacacatca ggaggataac ggaacggtgg tgcagggagc agggaaaaat   1980
```

```
aatattcaga caaaagcagg tattcgtgca tcctggaagg tgaaaagcac cctggataag   2040

gataccgggc ggaggttccg tccgtatata gaggcaaact ggatccataa cactcatgaa   2100

tttggtgtta aaatgagtga tgacagccag ttgttgtcag gtagccgaaa tcagggagag   2160

ataaagacag gtattgaagg ggtgattact caaaacttgt cagtgaatgg cggagtcgca   2220

tatcaggcag gaggtcacgg gagcaatgcc atctccggag cactggggat aaaatacagc   2280

ttctgataat agtacctgtg aagtgaaaaa tggcgcacat tgcgcgacat tttttttgtc   2340

tgccgtttac cgc                                                      2353
```

<210> SEQ ID NO 6
<211> LENGTH: 60
<212> TYPE: DNA
<213> ORGANISM: artificial
<220> FEATURE:
<223> OTHER INFORMATION: plasmid sequence

<400> SEQUENCE: 6

```
tacctgtgaa gtgaaaaatg gcgcacattg cgcgacattt tttttgtctg ccgtttaccg     60
```

<210> SEQ ID NO 7
<211> LENGTH: 7252
<212> TYPE: DNA
<213> ORGANISM: artificial
<220> FEATURE:
<223> OTHER INFORMATION: plasmid

<400> SEQUENCE: 7

```
actccgcgca catttccccg aaaagtgcca cctccgcggg acgtctaaga aaccattatt     60

atcatgacat taacctataa aaataggcgt atcacgaggc acgcgtcctt tcgtcctcaa    120

gaattctcat gtttgacagc ttatcatcga taagctttaa tgcggtagtt tatcacagtt    180

aaattgctaa cgcagtcagg caccgtgtat gaaatctaac aatgcgctca tcgtcatcct    240

cggcaccgtc accctggatg ctgtaggcat aggcttggtt atgccggtac tgccgggcct    300

cttgcgggat atcgtccatt ccgacagcat cgccagtcac tatggcgtgc tgctagcgct    360

atatgcgttg atgcaatttc tatgcgcacc cgttctcgga gcactgtccg accgctttgg    420

ccgccgccca gtcctgctcg cttcgctact tggagccact atcgactacg cgatcatggc    480

gaccacaccc gtcctgtgga tcctctacgc cggacgcatc gtggccggca tcaccggcgc    540

cacaggtgcg gttgctggcg cctatatcgc cgacatcacc gatggggaag atcgggctcg    600

ccacttcggg ctcatgagcg cttgtttcgg cgtgggtatg gtggcaggcc ccgtggccgg    660

gggactgttg ggcgccatct ccttgcatgc accattcctt gcggcggcgg tgctcaacgg    720

cctcaaccta ctactgggct gcttcctaat gcaggagtcg cataagggag agcgtcgacc    780

gatgcccttg agagccttca acccagtcag ctccttccgg tgggcgcggg gcatgactat    840

cgtcgccgca cttatgactg tgttctttat catgcaactc gtaggacagg tgccggcagc    900

gctctgggtc attttcggcg aggaccgctt tcgctggagc gcgacgatga tcggcctgtc    960

gcttgcggta ttcggaatct tgcacgccct cgctcaagcc ttcgtcactg gtcccgccac   1020

caaacgtttc ggcgagaagc aggccattat cgccggcatg gcggccgacg cgctgggcta   1080

cgtcttgctg gcgttcgcga cgcgaggctg gatggccttc cccattatga ttcttctcgc   1140

ttccggcggc atcgggatgc ccgcgttgca ggccatgctg tccaggcagg tagatgacga   1200

ccatcaggga cagcttcaag gatcgctcgc ggctcttacc agcctaactt cgatcattgg   1260
```

-continued

```
accgctgatc gtcacggcga tttatgccgc ctcggcgagc acatggaacg ggttggcatg   1320
gattgtaggc gccgccctat accttgtctg cctccccgcg ttgcgtcgcg gtgcatggag   1380
ccgggccacc tcgacctgat aatagatcga tacgcgtatg gaagccggcg gcacctcgct   1440
aacggattca ccactccaag aattggagcc aatcaattct tgcggagaac tgtgaatgcg   1500
caaaccaacc cttggcagaa catatccatc gcgtccgcca tctccagcag ccgcacgcgg   1560
cgcatctcgg gcagcgttgg gtcctggcca cgggtgcgca tgatcgtgct cctgttctag   1620
aaagtgatta tgtagcccta cgcctacgcc gttatttaac cttctccgaa tttaaatcag   1680
aattagcacc gcacttcggg ctggggctag atggctatgc acttggacat ccccaattcg   1740
taaatattct gacatggtta atcatcgctt aatcaaagcc gtgcttgccc aacagccttg   1800
cgaaaaacca caaagtgatg tattggcacg tttgcaagaa gctcgccgcc aaaatcgcct   1860
cgtcgaacgt gatattgccg attggctata ttgccgttat ctttcgccga aagtggctga   1920
aaatgtggaa tttaatgcag aagtgcaaga tgtaatgcgg gcagcgttac gcgtacaact   1980
gctcgaaaat ggtgcatcgc tattcattcc tgctgccacc ttgcacaaca acaaagaaga   2040
aatacaacta aaccctgatg aactcgctct ttacataaaa ggcgaccgca cttataaaat   2100
cggcgacatg gtaaaagtga aactcacaga agtgaaagaa accacacgca gcattgtcgg   2160
cgaaatcgtt caataaattg ccgttccctt ttgcctaaaa cctgctttca atgccagaaa   2220
gcaggttttt cttttaattt ttaccgcact tttcaacaaa aaacacctaa aatgagtcat   2280
gattaatctt ttttcttgct aaaaagaaat aaaagataaa taaacctaaa ccttatttta   2340
aataaaaaat aaattaactt atctgaaaag atttgatttt tgtgtaaata tttgtttttc   2400
ttattttttt tttttttttt tttttttttt tttttttttt tgaggctaaa cttttcgcaa   2460
aatatcactt ttttattctc caaatataga atagaatgcg cgtgatttca ctaagaaaag   2520
tatatttatc attaatttta ttaaatataa ggtaaataaa aatgaacaaa atttttaacg   2580
ttatttggaa tgttgtgact caaacttggg ttgtcgtatc tgaactcact cgcacccaca   2640
ccaaatgcgc ctccgccacc gtggcagttg ccgtattggc aaccctgttg tccgcaacgg   2700
ttcaggcgaa tcacggtgtg ttaaccctgt cttctcgtgg tctggactat ccatacgatg   2760
taccggatta cgcgcgttat ggaagacgaa ataagggatg gtatttaacc gtgttaacca   2820
tggagatctt cgaaaacgtc gcggcaggcg aaatttctgc cacttccacc gatgcgatta   2880
acggaagcca gttgtatgcc gtggcaaaag gggtaacaaa ccttgctgga caagtgaata   2940
atcttgaggg caaagtgaat aaagtgggca aacgtgcaga tgcaggtact gcaagtgcat   3000
tagcggcttc acagttacca caagccacta tgccaggtaa atcaatggtt tctattgcgg   3060
gaagtagtta tcaaggtcaa aatggtttag ctatcggggt atcaagaatt tccgataatg   3120
gcaaagtgat tattcgcttg tctggcacaa ccaatagtca aggtaaaaca ggcgttgcag   3180
caggtgttgg ttaccagtgg taaagtttgg attatctctc ttaaaaacgg catttgccgc   3240
tttttttatg ggtggctatt atgtatcgtt tcaaccaaat gaatttgtgc taaatttcct   3300
tttgatggtt aaagtgcggt gtttttaaat tgaacacaga tgcgtaagga gaaaataccg   3360
catcaggcgc tcttccgctt cctcgctcac tgactcgctg cgctcggtcg ttcggctgcg   3420
gcgagcggta tcagctcact caaaagcttg gctgtctcag gtttgttcct gattggttac   3480
ggcgcgtttc gcatcattgt tgagtttttc cgccagcccg acgcgcagtt taccggtgcc   3540
tgggtgcagt acatcagcat ggggcaaatt ctttccatcc cgatgattgt cgcgggtgtg   3600
atcatgatgg tctgggcata tcgtcgcagc ccacagcaac acgtttcctg aggaaccatg   3660
```

aaacagtatt tagaactgat gcaaaaagtg ctcgacgaag gcacacagaa aaacgaccgt 3720
accggaaccg gaacgctttc catttttggt catcagatgc gttttaacct gcaagatgga 3780
ttcccgctgg tgacaactaa acgttgccac ctgcgttcca tcatccatga actgctgtgg 3840
tttctgcagg gcgacactaa cattgcttat ctacacgaaa acaatgtcac catctgggac 3900
gaatgggccg atgaaaacgg cgacctcggg ccagtgtatg gtaaacagtg gcgcgcctgg 3960
ccaacgccag atggtcgtca tattgaccag atcactacgg tactgaacca gctgaaaaac 4020
gacccggatt cgcgccgcat tattgtttca gcgtggaacg taggcgaact ggataaaatg 4080
gcgctggcac cgtgccatgc attcttccag ttctatgtgg cagacggcaa actctcttgc 4140
cagctttatc agcgctcctg tgacgtgttc ctcggcctgc cgttcaacat tgccagctac 4200
gcattattgg tgcatatgat ggcgcagcag tgcgatctgg aagtgggtga ttttgtctgg 4260
accggtggcg acacgcatct gtacagcaac catatggatc aaactcatct gcaattaagc 4320
cgcgaaccgc gtccgctgcc gaagttgatt atcaaacgta aacccgaatc catcttcgac 4380
taccgtttcg aagattttga gattgaaggc tacgatccgc atccgggcat taaagcgccg 4440
gtggctatct aattacgaaa catcctgcca gagccgacgc cagtgtgcgt cggtttttt 4500
accctccgtt aaattcttcg atccgccttc ccgaaatttt gcaacgtcct gcaacggcgt 4560
aaatagtccg gaagatgcgc cgaagaaata gaaactggcc aagcttcgcc cgggcaggaa 4620
agaacatgtt taattaacgc cgagacctta tattccccag aacatcaggt taatggcgtt 4680
tttgatgtca ttttcgcggt ggctgagatc agccacttct tccccgataa cggaaaccgg 4740
cacactggcc atatcggtgg tcatcatgcg ccagctttca tccccgatat gcaccaccgg 4800
gtaaagttca cgggagactt tatctgacag cagacgtgca ctggccaggg ggatcaccat 4860
ccgtcgcccg ggcgtgtcaa taatatcact ctgtacatcc acaaacagac gataacggct 4920
ctctctttta taggtgtaaa ccttaaactg catttcacca gcccctgttc tcgtcagcaa 4980
aagagccgtt catttcaata aaccgggcga cctcagccat cccttcctga ttttccgctt 5040
tccagcgttc ggcacgcaga cgacgggctt cattctgcat ggttgtgctt accagaccgg 5100
agatattgac atcatatatg ccttgagcaa ctgatagctg tcgctgtcaa ctgtcactgt 5160
aatacgctgc ttcatagcat acctcttttt gacatacttc gggtatacat atcagtatat 5220
attcttatac cgcaaaaatc agcgcgcaaa tatgcatact gttatctggc ttttagtaag 5280
ccggtctcag gattaattaa gagcaaaagg ccagccctag gaaaaaggcg gtaatacggt 5340
tatccacaga atcaggggat aacgcaggaa agaacatgtg agcaaaaggc cagcaaaagg 5400
ccaggaaccg taaaaaggcc gcgttgctgg cgtttttcca taggctccgc ccccctgacg 5460
agcatcacaa aaatcgacgc tcaagtcaga ggtggcgaaa cccgacagga ctataaagat 5520
accaggcgtt tccccctgga agctccctcg tgcgctctcc tgttccgacc ctgccgctta 5580
ccggatacct gtccgccttt ctcccttcgg gaagcgtggc gctttctcat agctcacgct 5640
gtaggtatct cagttcggtg taggtcgttc gctccaagct gggctgtgtg cacgaacccc 5700
ccgttcagcc cgaccgctgc gccttatccg gtaactatcg tcttgagtcc aacccggtaa 5760
gacacgactt atcgccactg gcagcagcca ctggtaacag gattagcaga gcgaggtatg 5820
taggcggtgc tacagagttc ttgaagtggt gggctaacta cggctacact agaagaacag 5880
tatttggtat ctgcgctctg ctgaagccag ttaccttcgg aaaaagagtt ggtagctctt 5940
gatccggcaa acaaaccacc gctggtagcg gtggtttttt tgtttgcaag cagcagatta 6000

```
cgcgcagaaa aaaaggatct caagaagatc ctttgatctt ttctacgggg tctgacgctc   6060

agtggaacga cgcgcgcgta actcacgtta agggattttg gtcatgagat tatcaaaaag   6120

gatcttcacc tagatccttt taaattaaaa atgaagtttt aaatcaatct aaagtatata   6180

tgagtaaact tgatctccgc gggacgtcga cagttaccaa tgcttaatca gtgaggcacc   6240

tatctcagcg atctgtctat ttcgttcatc catagttgcc tgactccccg tcgtgtagat   6300

aactacgata cgggagggct taccatctgg ccccagcgct gcgatgatac cgcgagaacc   6360

acgctcaccg gctccggatt tatcagcaat aaaccagcca gccggaaggg ccgagcgcag   6420

aagtggtcct gcaactttat ccgcctccat ccagtctatt aattgttgcc gggaagctag   6480

agtaagtagt tcgccagtta atagtttgcg caacgttgtt gccatcgcta caggcatcgt   6540

ggtgtcacgc tcgtcgtttg gtatggcttc attcagctcc ggttcccaac gatcaaggcg   6600

agttacatga tcccccatgt tgtgcaaaaa agcggttagc tccttcggtc ctccgatcgt   6660

tgtcagaagt aagttggccg cagtgttatc actcatggtt atggcagcac tgcataattc   6720

tcttactgtc atgccatccg taagatgctt ttctgtgact ggtgagtact caaccaagtc   6780

attctgagaa tagtgtatgc ggcgaccgag ttgctcttgc ccggcgtcaa tacgggataa   6840

taccgcgcca catagcagaa ctttaaaagt gctcatcatt ggaaaacgtt cttcggggcg   6900

aaaactctca aggatcttac cgctgttgag atccagttcg atgtaaccca ctcgtgcacc   6960

caactgatct tcagcatctt ttactttcac cagcgtttct gggtgagcaa aaacaggaag   7020

gcaaaatgcc gcaaaaaagg gaataagggc gacacggaaa tgttgaatac tcatattctt   7080

cctttttcaa tattattgaa gcatttatca gggttattgt ctcatgagcg gatacatatt   7140

tgaatgtatt tagaaaaata aacaaatagg ggtcagtgtt acaaccaatt aaccaattct   7200

gaacattatc gcgagcccat ttatacctga atatggctca taacacccct tg           7252
```

<210> SEQ ID NO 8
<211> LENGTH: 642
<212> TYPE: DNA
<213> ORGANISM: artificial
<220> FEATURE:
<223> OTHER INFORMATION: plasmid sequence

<400> SEQUENCE: 8

```
atgaacaaaa tttttaacgt tatttggaat gttgtgactc aaacttgggt tgtcgtatct     60

gaactcactc gcacccacac caaatgcgcc tccgccaccg tggcagttgc cgtattggca    120

accctgttgt ccgcaacggt tcaggcgaat cacggtgtgt taaccctgtc ttctcgtggt    180

ctggactatc catacgatgt accggattac gcgcgttatg gaagacgaaa taagggatgg    240

tatttaaccg tgttaaccat ggagatcttc gaaaacgtcg cggcaggcga aatttctgcc    300

acttccaccg atgcgattaa cggaagccag ttgtatgccg tggcaaaagg ggtaacaaac    360

cttgctggac aagtgaataa tcttgagggc aaagtgaata aagtgggcaa acgtgcagat    420

gcaggtactg caagtgcatt agcggcttca cagttaccac aagccactat gccaggtaaa    480

tcaatggttt ctattgcggg aagtagttat caaggtcaaa atggtttagc tatcggggta    540

tcaagaattt ccgataatgg caaagtgatt attcgcttgt ctggcacaac caatagtcaa    600

ggtaaaacag gcgttgcagc aggtgttggt taccagtggt aa                       642
```

<210> SEQ ID NO 9
<211> LENGTH: 20
<212> TYPE: DNA
<213> ORGANISM: artificial

-continued

```
<220> FEATURE:
<223> OTHER INFORMATION: synthetic primer

<400> SEQUENCE: 9

agrgtttgat cmtggctcag                                                20


<210> SEQ ID NO 10
<211> LENGTH: 19
<212> TYPE: DNA
<213> ORGANISM: artificial
<220> FEATURE:
<223> OTHER INFORMATION: synthetic primer

<400> SEQUENCE: 10

ggttaccttg ttacgactt                                                 19


<210> SEQ ID NO 11
<211> LENGTH: 18
<212> TYPE: DNA
<213> ORGANISM: artificial
<220> FEATURE:
<223> OTHER INFORMATION: synthetic primer

<400> SEQUENCE: 11

tccggttgat cctgccrg                                                  18
```

What is claimed is:

1. A method of screening for peptides or proteins that elicit an immune response, comprising:

providing a pre-inoculation expression library comprising a plurality of host organism clones, wherein each individual member of the expression library is a clone that expresses a target peptide or protein from an expression vector encoding said target peptide or protein and a unique DNA barcode, wherein each member of the expression library contains an unique DNA barcode;

inoculating said pre-inoculation expression library into a gastrointestinal tract of an animal;

collecting feces from said animal at a time point after inoculation;

extracting plasmid DNA from said pre-inoculation library and from feces collected from said animal after inoculation;

determining the relative abundance of an individual member of the expression library prior to inoculation; and determining the relative abundance of the individual member of the expression library after inoculation; and identifying clones that show at least 10% reduction in the relative abundance in feces collected after inoculation into the animal.

2. The method of claim 1, wherein said target peptide contains 8-50 amino acid residues.

3. The method of claim 1, wherein the relative abundance of each expression vector in said pre-inoculation library and in feces collected from said animal after inoculation is determined by detecting said DNA barcode in each expression vector using a microarray that recognizes DNA barcodes on individual members of the expression library.

4. The method of claim 1, wherein the relative abundance of each expression vector in said pre-inoculation library and in feces collected from said animal after inoculation is determined by detecting said DNA barcode in each expression vector by DNA sequencing.

5. The method of claim 1, wherein the relative abundance of each expression vector in said pre-inoculation library and in feces collected from said animal after inoculation is determined by detecting said DNA barcode in each expression vector using specific PCR primers or detection probes.

6. The method of claim 1, wherein said host organism clones are selected from the group consisting of bacteria, yeast, fungi and protozoa.

* * * * *